US012790073B2

(12) United States Patent
Tippmann et al.

(10) Patent No.: US 12,790,073 B2
(45) Date of Patent: Nov. 10, 2026

(54) FLEXIBLE SEAL FOR PALLETIZED HEAT TRANSFER SYSTEM

(71) Applicant: Tippmann Engineering, LLC, Fort Wayne, IN (US)

(72) Inventors: Robert T. Tippmann, Fort Wayne, IN (US); Daniel J. Tippmann, Fort Wayne, IN (US)

(73) Assignee: Tippmann Engineering, LLC, Fort Wayne, IN (US)

( * ) Notice: Subject to any disclaimer, the term of this patent is extended or adjusted under 35 U.S.C. 154(b) by 0 days.

(21) Appl. No.: 18/843,238

(22) PCT Filed: Mar. 17, 2023

(86) PCT No.: PCT/US2023/015430

§ 371 (c)(1),
(2) Date: Aug. 31, 2024

(87) PCT Pub. No.: WO2023/177829

PCT Pub. Date: Sep. 21, 2023

(65) Prior Publication Data

US 2025/0100746 A1 Mar. 27, 2025

Related U.S. Application Data

(60) Provisional application No. 63/320,988, filed on Mar. 17, 2022.

(51) Int. Cl.
*B65D 19/38* (2006.01)
*B65D 81/18* (2006.01)

(52) U.S. Cl.
CPC ..... *B65D 19/38* (2013.01); *B65D 81/18* (2013.01); *B65D 2519/00537* (2013.01)

(58) Field of Classification Search
CPC .... B65D 90/046; B65D 88/005; B65D 19/38; B65D 2519/00537
See application file for complete search history.

(56) References Cited

U.S. PATENT DOCUMENTS 4,824,685 A 4/1989 Bianco
6,305,148 B1 10/2001 Bowden et al.
(Continued)

FOREIGN PATENT DOCUMENTS

DE 102015102328 A1 8/2016
EP 430048 A1 11/1990
(Continued)

OTHER PUBLICATIONS

European Search Report for related application No. 23771428.2, dated Feb. 16, 2026.

*Primary Examiner* — Daniel Jeremy Leeds
(74) *Attorney, Agent, or Firm* — Brian S. Bailey

(57) ABSTRACT

A sheet-based cover assembly can be used to create an air seal around a palletized product assembly. The assembly includes a plurality of flexible poles which support a covering. In an at-rest state unaffected by external forces, the flexible poles hold the covering open and allow the palletized product assembly to be installed in position, ready to be acted on by a vacuum-creating fan or air handler. When the fan is activated, the vacuum draws the covering tight around the palletized product assembly, deflecting the poles under the force of the vacuum pressure created by the fan. The sheet covering is flexible but relatively air-impermeable, such that the vacuum created behind the palletized product assembly flows primarily through, rather than around, the product.

25 Claims, 19 Drawing Sheets

(56) References Cited

U.S. PATENT DOCUMENTS

| | | | | |
|---|---|---|---|---|
| 6,340,043 | B1 | 1/2002 | Paupardin | |
| 8,459,180 | B2 | 6/2013 | Paupardin et al. | |
| 10,194,682 | B2 | 2/2019 | Tippmann | |
| 11,073,322 | B2 | 7/2021 | Tippmann et al. | |
| 2014/0044378 | A1* | 2/2014 | Loeschen | B65D 88/005 383/2 |
| 2017/0086485 | A1 | 3/2017 | Tippmann | |
| 2021/0161312 | A1* | 6/2021 | Paupardin | F25D 17/045 |

FOREIGN PATENT DOCUMENTS

| | | | |
|---|---|---|---|
| FR | 2938242 | B1 | 11/2008 |
| GB | 1284270 | A | 8/1972 |
| JP | S57112681 | U | 7/1982 |
| WO | 2021058326 | A1 | 4/2021 |

* cited by examiner

FLEXIBLE SEAL FOR PALLETIZED HEAT TRANSFER SYSTEM

CROSS-REFERENCE TO RELATED APPLICATIONS

This application is a national-stage application under 35 U.S.C. 371 of International Application No. PCT/US2023/015430, filed Mar. 17, 2023 and entitled FLEXIBLE SEAL FOR PALLETIZED HEAT TRANSFER SYSTEM, which claims the benefit of U.S. Provisional Application No. 63/320,988 filed Mar. 17, 2022 and entitled FLEXIBLE SEAL FOR PALLETIZED HEAT TRANSFER SYSTEM, the entire disclosures of which are hereby expressly incorporated herein by reference.

BACKGROUND

1. Technical Field

The present disclosure relates to palletized product warehousing and treatment. More particularly, the present disclosure relates to spacing, stacking and heat transfer structures used in a warehouse that is capable of altering and/or holding steady the temperature of a quantity of palletized product.

2. Description of the Related Art

Freezer warehouses are known in which large pallets of items including meats, fruit, vegetables, prepared foods, and the like are frozen in blast rooms of a warehouse and then are moved to a storage part of the warehouse to be maintained at a frozen temperature until their removal.

U.S. Pat. No. 8,783,047 entitled "Rack-Aisle Freezing System for Palletized Product", filed on Sep. 8, 2010, the entire disclosure of which is hereby explicitly incorporated by reference herein, relates to an improved system for freezing food products. Shown in FIG. 1 is a large warehouse 2 that can be used to freeze and maintain perishable foods or like products. Large pallets of items, including meats, fruits, vegetables, prepared foods, and the like, are sent to warehouse 2 to be frozen employing a system whereby the palletized foods are frozen on storage racks.

FIG. 2 shows a top view of the interior of warehouse 2, in which rows of palletized product are shown such that pallet assemblies 52 abut chamber 6. As shown in FIG. 3, rows of racking 14 (see also FIG. 8) are positioned between aisles 10 and chambers 6. Each chamber 6 is enclosed by a pair of end walls 15 and top panel 17. Spacers 20 (FIGS. 5-7) separate respective rows of cases 22 to create a palletized product stack in the form of pallet assembly 52 which can be disposed and sealed against the exterior of racking 14 (FIG. 3) via forklifts 18 (see, e.g., FIGS. 3 and 4).

Air handlers 8, e.g., chillers or heaters (FIG. 2) provided in the interior of warehouse 2 produce conditioned, e.g., cold or warmed air and maintain the temperature of ambient air within the warehouse space at a desired temperature, e.g., +55° F. to −30° F. Thus, for purposes of the present disclosure, "air conditioner" refers to an air handler which can produce air conditioned to a desired state, e.g., heated or cooled. While warehouse 2 could be utilized to either freeze, cool or thaw a quantity of product housed in cases contained on pallet assemblies 52, the remaining description will use the example of a warehouse freezer, it being understood that similar arrangements and principles will be applied to a warehouse utilized to thaw product, with the air handler comprising a heater as opposed to a chiller.

Adjacent pairs of racking structures 14 (FIGS. 2-4) define a plurality of adjacent airflow chambers 6 (FIGS. 2 and 4) having air intake openings on opposite sides thereof and a plurality of air outlets having air moving devices, such as exhaust fans 12, on top panels 17, which cause conditioning air to be drawn into chambers 6 through the air intake openings in racking 14 and to then exhaust into the warehouse space. The plurality of airflow chambers 6 are each defined by a pair of end walls 15 and top wall 17 having one or more air outlets and exhaust fans 12 associated therewith (FIG. 3). Pallet assemblies 52 (FIG. 5) are pressed against the intake openings in racking 14 such that a seal is formed between the pallets and the intake openings via side periphery seals, a bottom periphery seal, and a top periphery seal. The seals together define each respective intake opening. Freezing air is drawn through air pathways 16 (FIGS. 2, 4, and 5) within the palletized product in a direction towards chamber 6 to thereby quickly freeze the product. As shown in FIG. 5, spacers 20 may be placed between rows of cases 22 of product in an attempt to provide air pathways 24 through which airflow can enter chamber 6.

U.S. Pat. No. 8,919,142 entitled "Swing Seal for a Rack-Aisle Freezing and Chilling System", filed on Mar. 29, 2011, the entire disclosure of which is hereby explicitly incorporated by reference herein, discloses a top periphery seal 40 (which may be referred to herein as a "swing seal") useable to seal an intake opening as described above and which automatically adjusts to the height of pallet assembly 52 as illustrated in FIG. 6. As illustrated in FIG. 6, pallet assembly 52 (comprised of a plurality of cases 22 stacked on spacers 20 and pallet 4) can be positioned along pallet guide 56 and pressed against airflow opening 54 such that a seal is formed between pallet assembly 52 and airflow opening 54 via side periphery seals, a bottom periphery seal and an automatically adjustable top periphery seal surrounding airflow opening 54. With such a construction, chilling or freezing air is drawn through air pathways 16 formed through pallet assembly 52, as illustrated in FIGS. 2, 4 and 5.

FIG. 5 illustrates predicate spacer 20 which is formed in an undulating "egg carton" configuration. As illustrated in FIG. 7, individual cases 22 can crush under the weight of the product contained therein and the product contained in cases stacked directly above to cause overlap of cases 22 with a spacer 20 and prohibit airflow between product cases 22 positioned on opposite sides of the obstructed spacer 20. Undulating spacers 20 are particularly susceptible to obstruction due to drooping or sagging cases 22 due to the inconsistent support structure caused by the "hill and valley" configuration of such spacers. FIG. 7 illustrates case crushing and drooping at various sides and levels of pallet assembly 52; however, this phenomenon is, in practice, more prevalently seen with respect to the spacers 20 separating lower rows of cases 22, as the bottom of pallet assembly 52 contains the heaviest cumulative load of cases 22 stacked thereon.

In the above described installation, utilizing "egg carton" spacers 20, heat transfer from chilled ambient air in warehouse 2 to the products contained in cases 22 is effected through forced convection which is facilitated by the irregular shape of egg carton spacers 20 to allow airflow in all directions through pallet assembly 52. Alternative spacers such as wood slat spacers may also be utilized to separate cases 22 on pallet 4.

For maximum effectiveness of thermal transfer between the conditioned air in warehouse 2 and the product contained in product cases 22, it is desirable to have air within the spacers continuously refreshed and replaced with conditioned air from warehouse 2. One way to achieve this air movement is to use fans 12 (FIGS. 3 and 4) to drive airflow through and around pallet assemblies 52.

SUMMARY

The present disclosure provides a sheet-based cover assembly which can be used to create an air seal around a palletized product assembly. The assembly includes a plurality of flexible poles which support a covering. In an at-rest state unaffected by external forces, the flexible poles hold the covering open and allow the palletized product assembly to be installed in position, ready to be acted on by a vacuum-creating fan or air handler. When the fan is activated, the vacuum draws the covering tight around the palletized product assembly, deflecting the poles under the force of the vacuum pressure created by the fan. The sheet covering is flexible but relatively air-impermeable, such that the vacuum created behind the palletized product assembly flows primarily through, rather than around, the product.

In one form thereof, the present disclosure provides a pallet sealing assembly including a support structure adjacent a pallet receiving area sized to receive a pallet assembly, the pallet receiving area served by a fan that is positioned and configured to move air from inside the pallet receiving area to outside the pallet receiving area, a plurality of flexible rods coupled to the support structure and extending away from the support structure; and a cover supported by the plurality of flexible rod. The plurality of flexible rods have sufficient rigidity to support the cover in an at-rest state such that the cover defines an opening around the pallet receiving area, the opening sized to receive a pallet assembly, and the plurality of flexible rods have sufficient flexibility to deflect into engagement with the pallet assembly upon activation of the fan.

In another form thereof, the present disclosure provides a method of air-conditioning a pallet assembly positioned in a pallet receiving area, a cover assembly positioned adjacent the pallet receiving area and including a plurality of flexible poles supporting a flexible cover, a fan fluidly coupled with the pallet receiving area through an internal volume. The method includes placing a pallet assembly within the pallet receiving area while the plurality of flexible poles are in an at-rest state, and operating the fan to create a negative pressure within the internal volume, to thereby bias the flexible cover into contact with the pallet assembly in an engaged state, in which the cover assembly inwardly deflects the flexible poles.

In yet another form thereof, the present disclosure provides an air handler assembly including an enclosure comprising a plurality of panels, the enclosure configured with an intake opening and an exhaust opening, and the enclosure coupled to a rack assembly, the intake opening positioned adjacent a pallet receiving area, the pallet receiving area sized to receive a pallet assembly, a plurality of flexible rods coupled to the support structure and extending away from the enclosure, and a flexible covering supported by the plurality of flexible rods. The plurality of flexible rods have sufficient rigidity to support the covering in a first state in which the covering defines an opening around the pallet receiving area, the opening sized to receive the pallet assembly, and the plurality of flexible rods have sufficient flexibility to deflect into a second state engaged with the pallet assembly in the presence of an airflow driven from the intake opening to the exhaust opening.

BRIEF DESCRIPTION OF THE DRAWINGS

The above mentioned and other features and objects of this invention, and the manner of attaining them, will become more apparent and the invention itself will be better understood by reference to the following description of an embodiment of the invention taken in conjunction with the accompanying drawings, where.

Figure 1:
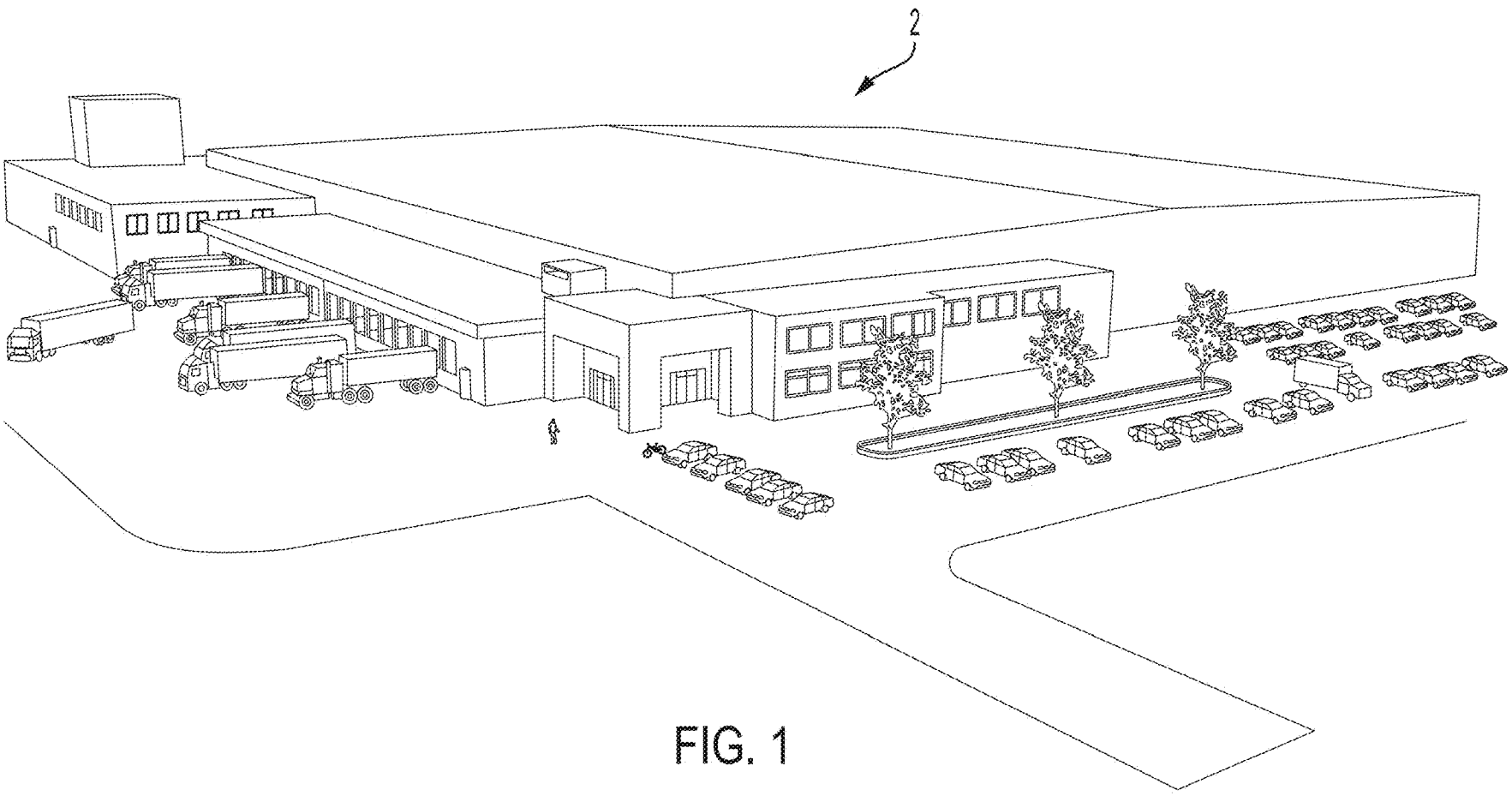
FIG. 1 is a perspective view of a warehouse incorporating a heat transfer system in accordance with the present disclosure.

Corresponding reference characters indicate corresponding parts throughout the several views. Although the exemplification set out herein illustrates an embodiment of the invention, the embodiment disclosed below is not intended to be exhaustive or to be construed as limiting the scope of the invention to the precise form disclosed.

DETAILED DESCRIPTION

The present disclosure provides a sheet-based seal system 200 including a fabric, or other sheet-based, covering 220 which is capable of being selectively held open by flexible rods 230, 232, 234, 236. Upon activation of an airflow fan, such as fan 12 or 212, covering 220 is drawn inwardly, deflecting rods 230, 232, 234, 236, such that covering 220 creates a seal around the palletized product assembly 52.

1. Palletized Product Environment, Assembly and Arrangement

Figure 2:
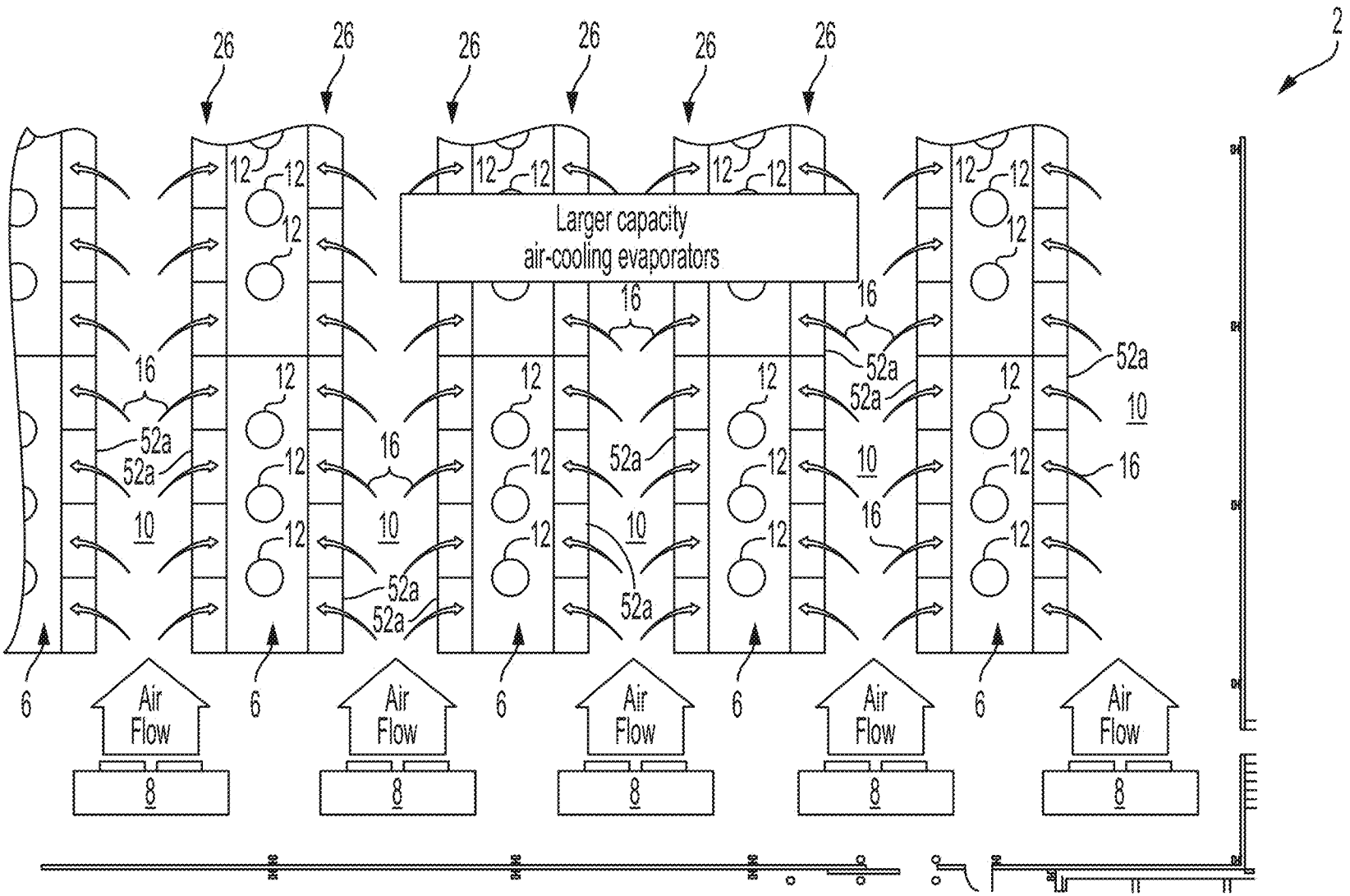
FIG. 2 is a diagrammatic top view of a heat transfer warehouse incorporating the system of the present disclosure.
Figure 3:
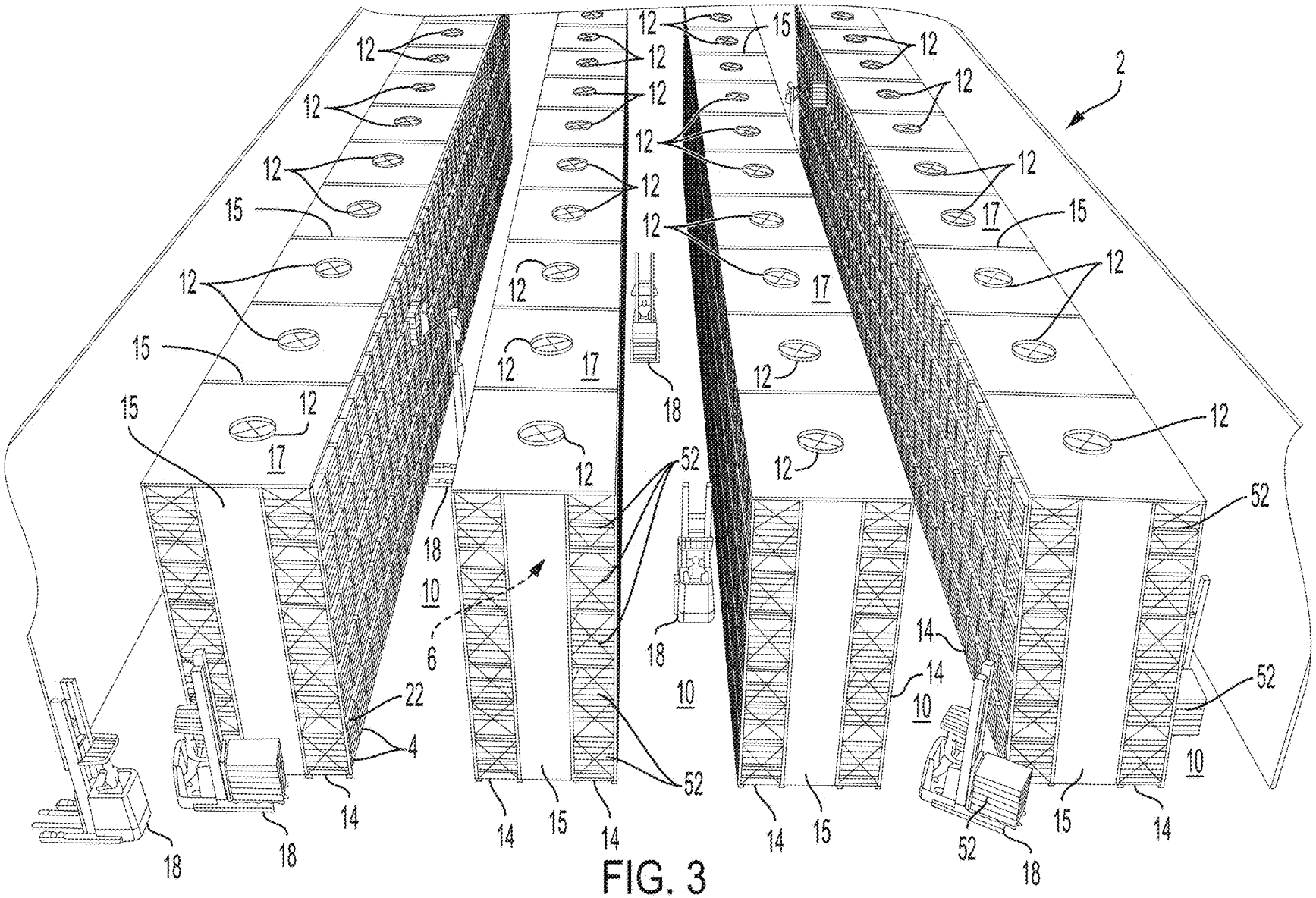
FIG. 3 is a perspective view of the interior of the warehouse illustrated in FIG. 1.
Figure 4:
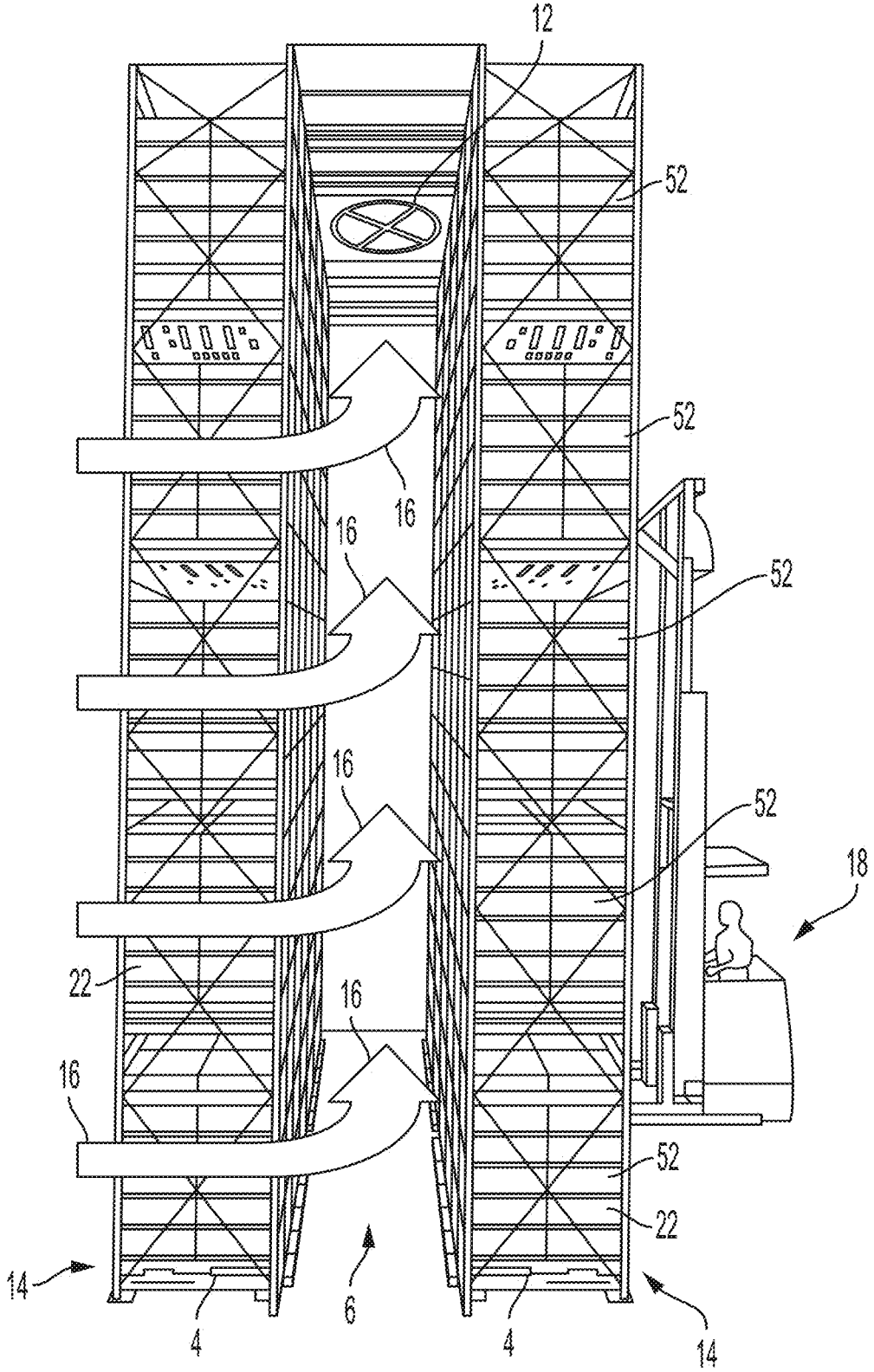
FIG. 4 is a perspective, end view of two rows of racking separated by an airflow chamber.

Pallet assemblies 52 form a part of warehouse installation 2 depicted, e.g., in FIG. 2. The general structure and components of warehouse 2 are described above in the background section of this document. A portion of this description will be repeated here to facilitate an understanding of the present invention. As illustrated in FIG. 2, warehouse 2 includes rack rows 26 separated by chambers 6 and aisles 10. As illustrated in FIGS. 3 and 4, racks 14 are sized for receiving a plurality of pallet assemblies 52. Racking 14 can be sized to receive a different number of pallet assemblies, as necessary. Different assemblies of racking 14 are illustrated, e.g., in FIGS. 3, 4, 8 and 10. As described in further detail below, "2-deep" racking 100 (shown in FIGS. 10 and 11) may be used interchangeably with racking 14 to facilitate the deployment of modular air handler assemblies 102, 302 (best shown in FIGS. 11 and 16A).

Figure 9:
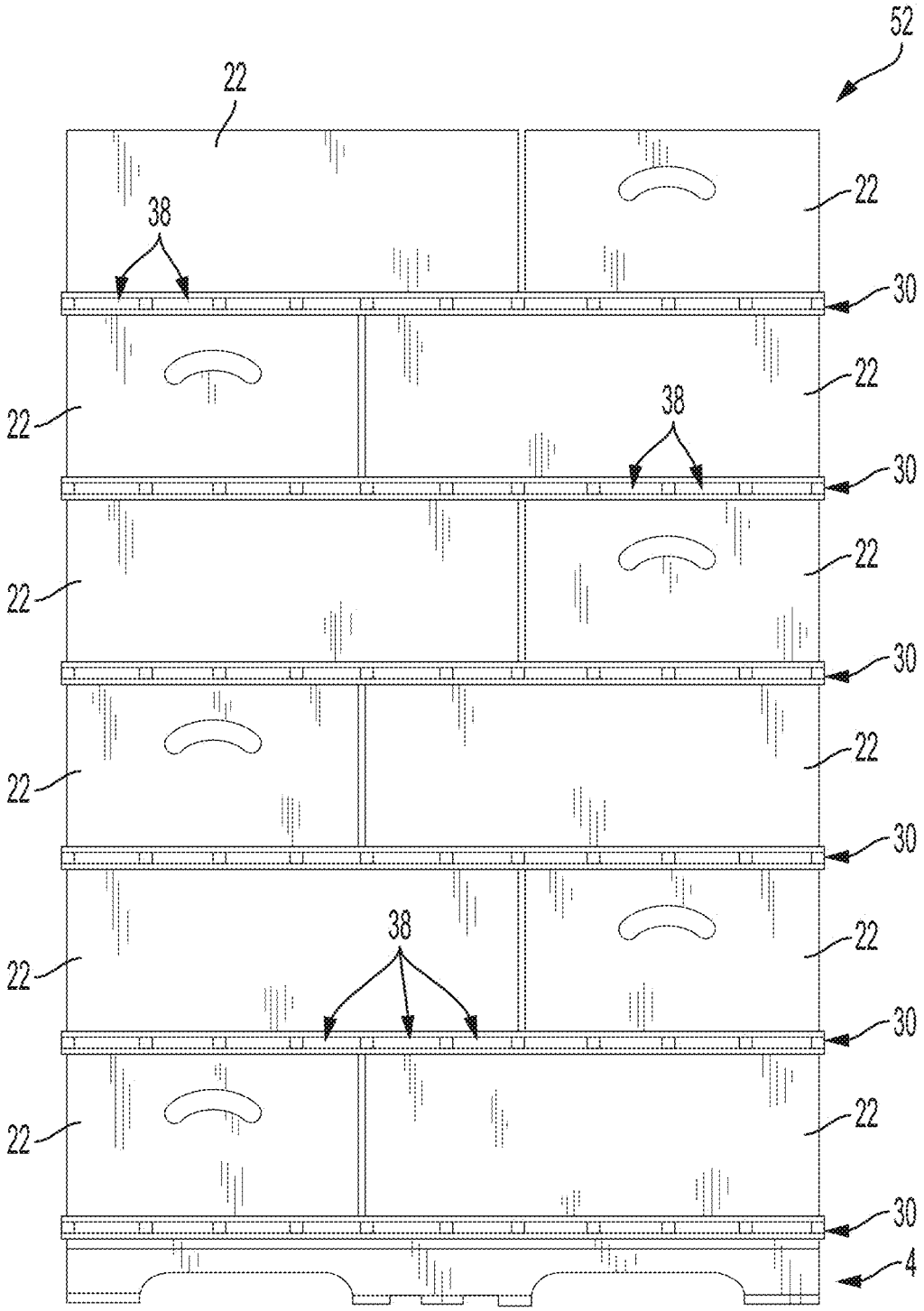
FIG. 9 is a side elevation view of a pallet assembly in accordance with the present disclosure.

As depicted, e.g., in FIG. 9, pallet assemblies 52 include pallet 4, on which a plurality of cases 22 are stacked, with spacers 30 interposed between layers of cases 22. Spacers 30 are provided to facilitate airflow across the entire downstream extent of pallet assemblies 52, thereby ensuring heat transferring airflows to all of cases 22 among the various layers stacked upon pallets 4. Exemplary spacers and other racking systems and structures which may be used in conjunction with the present disclosure are described in U.S. Patent Application Publication No. 2014/0273793, filed Jan. 28, 2014 and entitled HEAT TRANSFER SYSTEM FOR WAREHOUSED GOODS, and in U.S. Patent Application Publication No. 2014/0273801, filed Mar. 15, 2013 and entitled SPACER FOR A WAREHOUSE RACK-AISLE HEAT TRANSFER SYSTEM, the entire disclosures of which are hereby explicitly incorporated herein by reference.

With pallet assemblies 52 arranged in rows and columns on racks 14 or racks 100, warehouse installation 2 can be utilized to raise, lower and/or maintain the temperature of a quantity of product contained in cases 22 to a desired set point. As illustrated in FIGS. 3 and 4, aisles 10 are sufficiently wide to allow forklifts 18 to access pallet assemblies 52. Typical aisle width is between 5 feet to 14 feet depending on the type of lift equipment. Pallet assemblies 52 each include a pallet 4 at the bottom thereof. As used in this document, "pallet" is used to denote a standard warehouse pallet of box section open at least two ends (some pallets are called 4-way pallets due to fork openings on all 4-sides) to allow the entry of the forks of a forklift so that a palletized load, i.e., pallet assembly 52, can be raised, moved about and set down easily.

Racks 14 define airflow openings 54 fluidly connected to a chamber 6, which, in the exemplary embodiment illustrated, is enclosed by a pair of end walls 15 and top panel 17. Pallet assemblies 52 are disposed and sealed against the air intake openings formed in racks 14, as described in detail below. Referring to FIG. 2, air handlers 8 are operably connected to (e.g., disposed within) warehouse space 2 so that air handlers 8 can condition (e.g., heat or cool) the ambient air in warehouse space to a desired temperature. In the event that warehouse space 2 is utilized to freeze product contained in cases 22, air handlers 8 may be chillers which produce air on the order of −5° F. to −30° F. In the event that warehouse space 2 is utilized to thaw product contained in cases 22, air handlers 8 may be heaters which produce air on the order of 30° F. to 60° F. Additional air handlers, illustratively fans 12, circulate ambient air conditioned by air handlers 8 such that air conditioned by air handlers 8 flows through pallet assemblies 52 and through airflow openings 54 formed in racks 14. Moreover, rack assembly 100 may be used for various heat transfer operations including freezing, thawing, chilling, heating or tempering of product contained within cases 22. Air handlers 8 may be provided in any configuration consistent with any of these operations, and may be operable to condition the air within warehouse space 2 in any desired manner as required or desired for a particular application, including conditioning for a particular temperature and/or humidity.

In one exemplary embodiment, pallet 4 defines a standard 40 inch by 48 inch rectangular outer perimeter. With such a pallet, the upper and lower surfaces of spacer 30 illustrated in FIG. 9 will both be substantially rectangular in shape and about 40 inches by about 48 inches. Stated another way, the upper and lower surfaces are both nominally rectangular and nominally measure about 40 inches by 48 inches. In certain alternative embodiments, spacers 30 will be slightly oversized with respect to pallet 4, e.g., by having an overhang of up to an inch relative to the perimeter of pallet 4. These embodiments are also considered to be sized and shaped "about congruent" to the outer perimeter of pallet 4. Alternative pallet sizes, such as a standard European pallet may be utilized. Spacers 30 may be about congruent with the pallet and cases with which the spacers 30 are paired.

Figure 5:
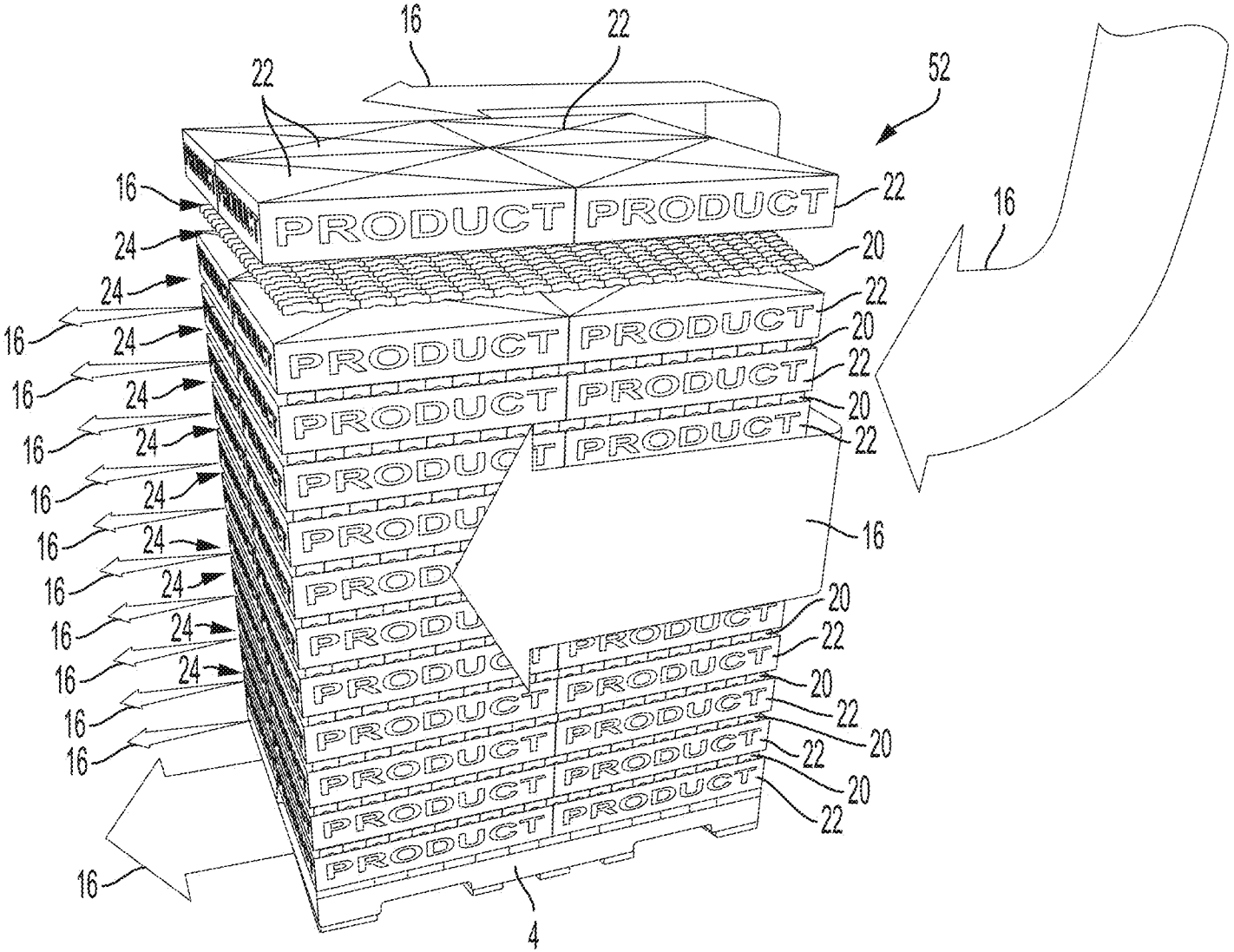
FIG. 5 is a perspective view showing a desired airflow through a pallet assembly.

As illustrated in, e.g., FIG. 9, spacers 30 may have longitudinal airflow channels 38 formed therethrough. Airflow channels 38 facilitate a generally longitudinal, directional flow of air through the spacer from an input at one side of the palletized product assembly 52 to an output at an opposite side. Further discussion of exemplary longitudinal channels and spacer arrangements can be found in U.S. Patent Application Publication No. 2014/0273793, filed Jan. 28, 2014 and entitled HEAT TRANSFER SYSTEM FOR WAREHOUSED GOODS, and in U.S. Patent Application Publication No. 2014/0273801, filed Mar. 15, 2013 and entitled SPACER FOR A WAREHOUSE RACK-AISLE HEAT TRANSFER SYSTEM, the entire disclosures of which are hereby explicitly incorporated herein by reference. Although spacers 30 provide enhanced airflow and heat transfer performance characteristics as compared to predicate spacers 20 (FIGS. 5-7) and are used in an exemplary embodiment of pallet assembly 52, it is contemplated that predicate spacers 20 may also be used in pallet assembly 52, as required or desired for a particular application.

2. Sheet-Based Pallet Seals

Figure 14:
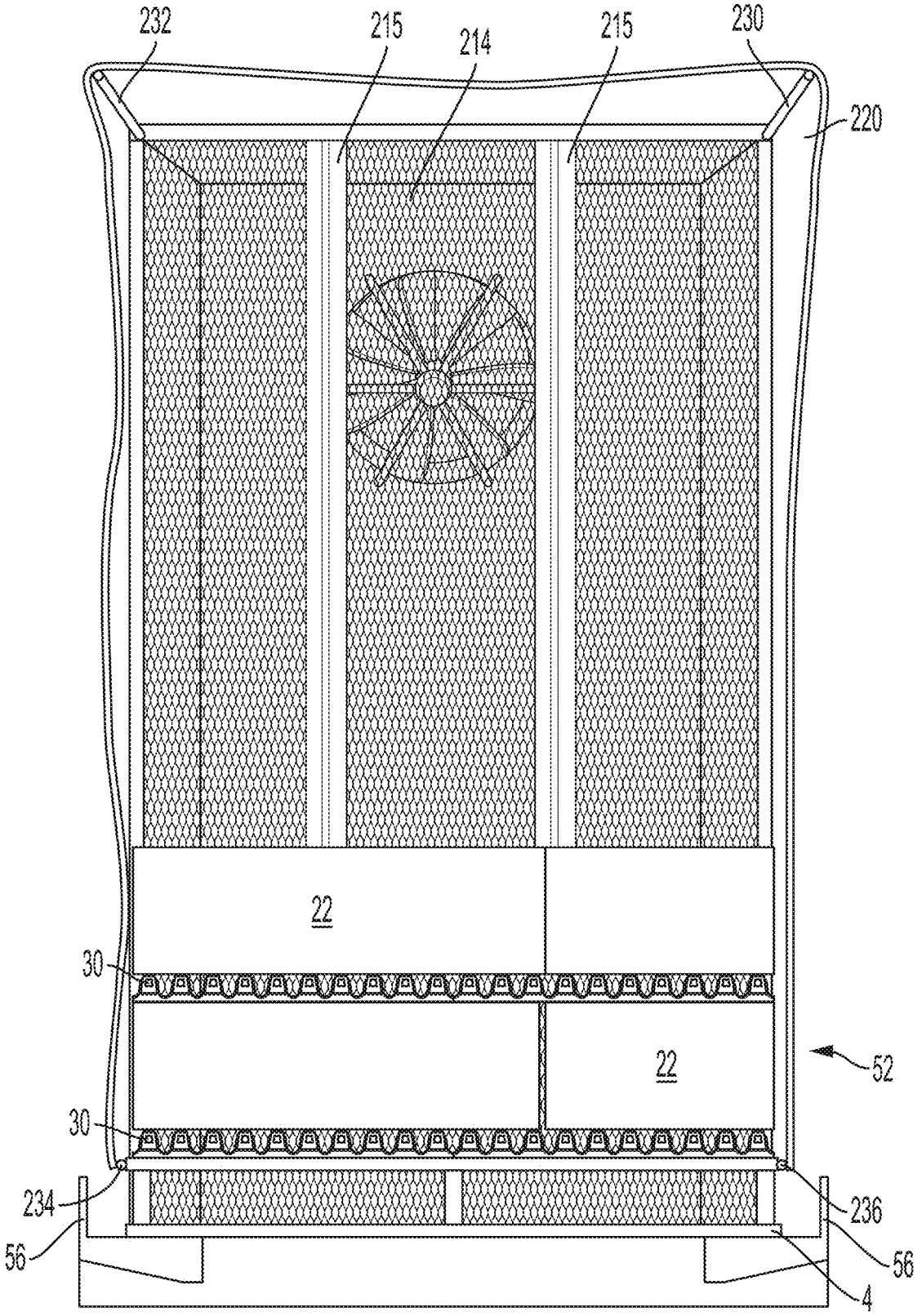
FIG. 14 is a front elevation view of the sheet-based seal system of FIG. 10, in an unengaged state, with a pallet assembly.

The present disclosure provides a sheet-based sealing system which uses a flexible sheet to selectively and automatically seal the edges of a pallet assembly 52 to aid in directing airflow therethrough. Generally speaking, a cover in accordance with the present disclosure is supported in an at-rest configuration in which the cover defines an opening around the pallet receiving area, the opening sized to receive the pallet assembly. An example of this configuration is shown in FIG. 14 with respect to a sheet or fabric-based system 200, further described below. This supported configuration allows pallets 52 to be freely and easily placed into the pallet receiving area, which may be one among a pallet receiving area in an array of pallet bays as shown and described above with respect to rack 14, or a single pallet bay as shown and described below with respect to system 200, or any other pallet receiving area.

The cover is deflectable from the open configuration into a collapsed configuration. During this deflection, the cover is drawn downwardly such that the cover can substantially sealingly engage the pallet 52 received within the opening. With the cover engaged, a heat transfer operation may be used to cool or warm the contents of the pallet assembly as further described herein, e.g., with respect to system 200. The repositioning of the cover in the collapsed configuration may be accomplished in various ways. In the illustrative embodiment of FIGS. 10-19, for example, the vacuum (negative pressure) resulting from activation of the fan 212 may be the motive force which draws the cover into the collapsed configuration. Other motive forces are also contemplated, such as dedicated actuators which may be electrically controllable and/or elastically deformable.

The cover can be configured to automatically reposition from the collapsed configuration into the open configuration once the motive force is removed. For example, the cover may be resiliently biased into the open configuration, such that a "natural" of default state of the cover is in the open configuration, absent a countervailing force. In this configuration of the cover system, the cover can be said to "passively" reposition without any affirmative signal or action. In the illustrative embodiment of seal system 200 described below, one or more flexible rods 230, 232, 234, 236 may provide such a resilient biasing. In particular, a pair of upper flexible rods 230, 232 may be used to hold the cover 220 in the open configuration. Alternatively, a single flexible rod may be used in some configurations.

Other resilient biasing structures may be used, such as elastically deformable ropes or cords, as required or desired for a particular application. In still other configurations and applications, electrically controllable actuators may be used to "actively," rather than passively, reposition the cover from the collapsed configuration to the open configuration. In such an "active" configuration of the cover system, an affirmative "open" signal or action is used to automatically open the cover.

Configuring the cover in the open and/or collapsed configurations may be accomplished without manual intervention, such as through an electronic controller. The controller may be programmed to receive an electronic activation signal, which may be issued directly by a human user of the cover system or by an automated system based on sensor data, schedules or other inputs. Upon receiving the electronic activation signal, the controller activates a sealing configuration of the cover system by automatically deflecting the cover from the at-rest configuration to the collapsed configuration. As noted above, this deflection may occur by activation of a fan, for example, or by another actuation.

Similarly, the controller may be programmed to receive an electronic de-activation signal, which may be issued directly by a human user of the cover system or by an automated system based on sensor data, schedules or other inputs. Upon receiving the electronic de-activation signal, the controller de-activating the sealing configuration of the cover system by automatically repositioning the cover from the collapsed configuration to the at-rest configuration. As noted herein, this automatic reposition may be passive, i.e., accomplished by removal of the motive force for collapsing the cover, or active, accomplished by affirmative application an opening force upon the cover.

Advantageously, the automatic reconfiguration of the present cover system allows a user to place the cover in the at-rest position when ready to place or retrieve a pallet assembly 52 within the adjacent pallet receiving area, then automatically engage the cover assembly when the pallet assembly 52 is in place and the heat transfer operation is ready to begin. Additionally, the open configuration of the cover system may define a opening periphery that in ample or oversized with respect to the size of the pallet assembly 52, so that precise positioning of the pallet assembly 52 is not necessary in order to achieve effective and efficient heat transfer.

Figure 10:
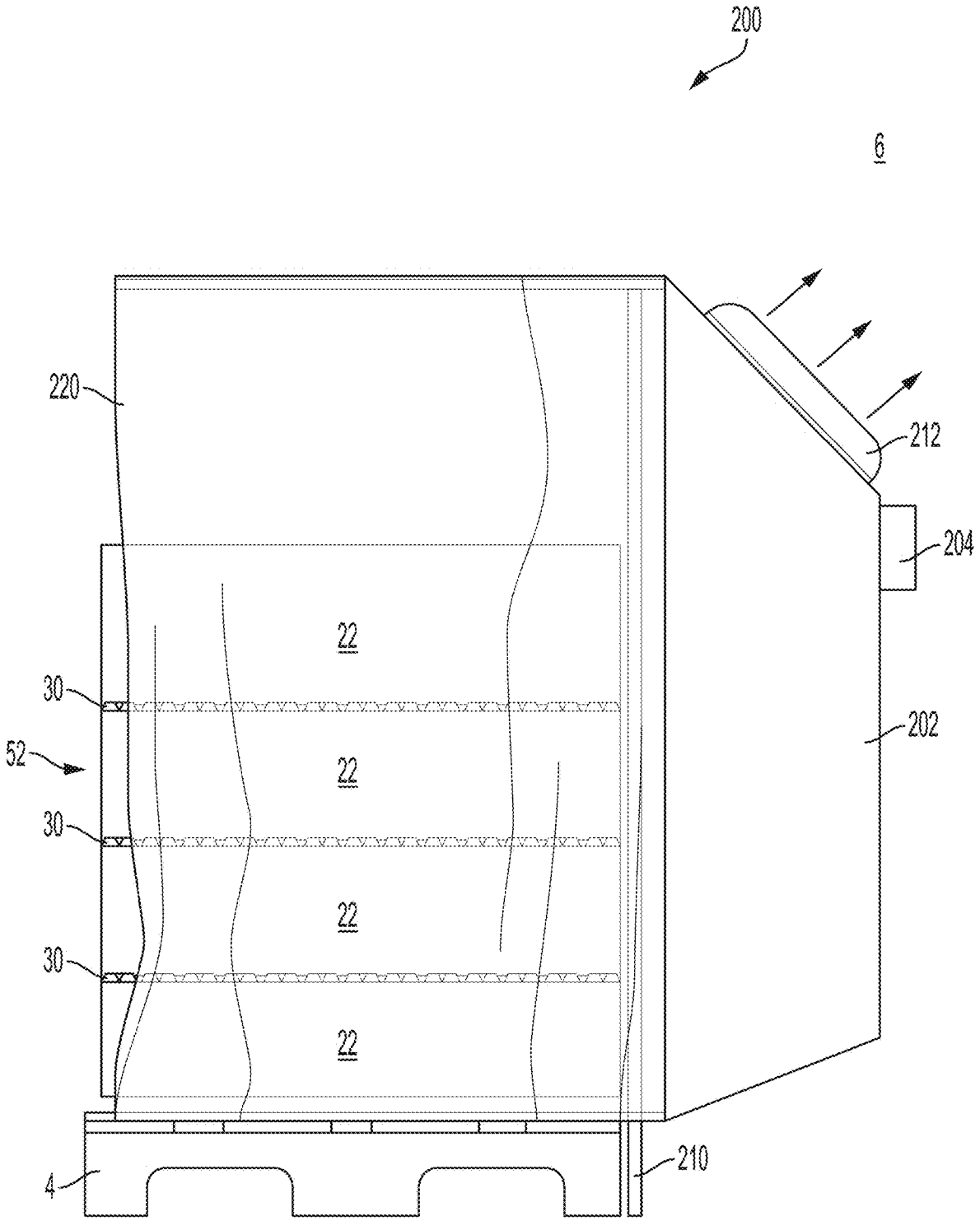
FIG. 10 is a right side elevation view of a sheet-based seal system made in accordance with the present disclosure, shown with a pallet assembly therein.

Turning now to FIG. 10, one exemplary embodiment of the present cover system is shown as a sheet-based seal system 200 which can be used to seal a pallet assembly 52 within a pallet receiving area sized to receive palletized product assembly 52. In particular, sheet-based seal system 200 utilizes a sheet material, such as fabric covering 220, to create an airtight seal on at least three sides of pallet assembly 52. For purposes of the present disclosure, fabric covering 220 will be described, it being understood that other sheet-based materials such as plastic, vinyl, or any other sheet-based material may be used.

Figure 6:
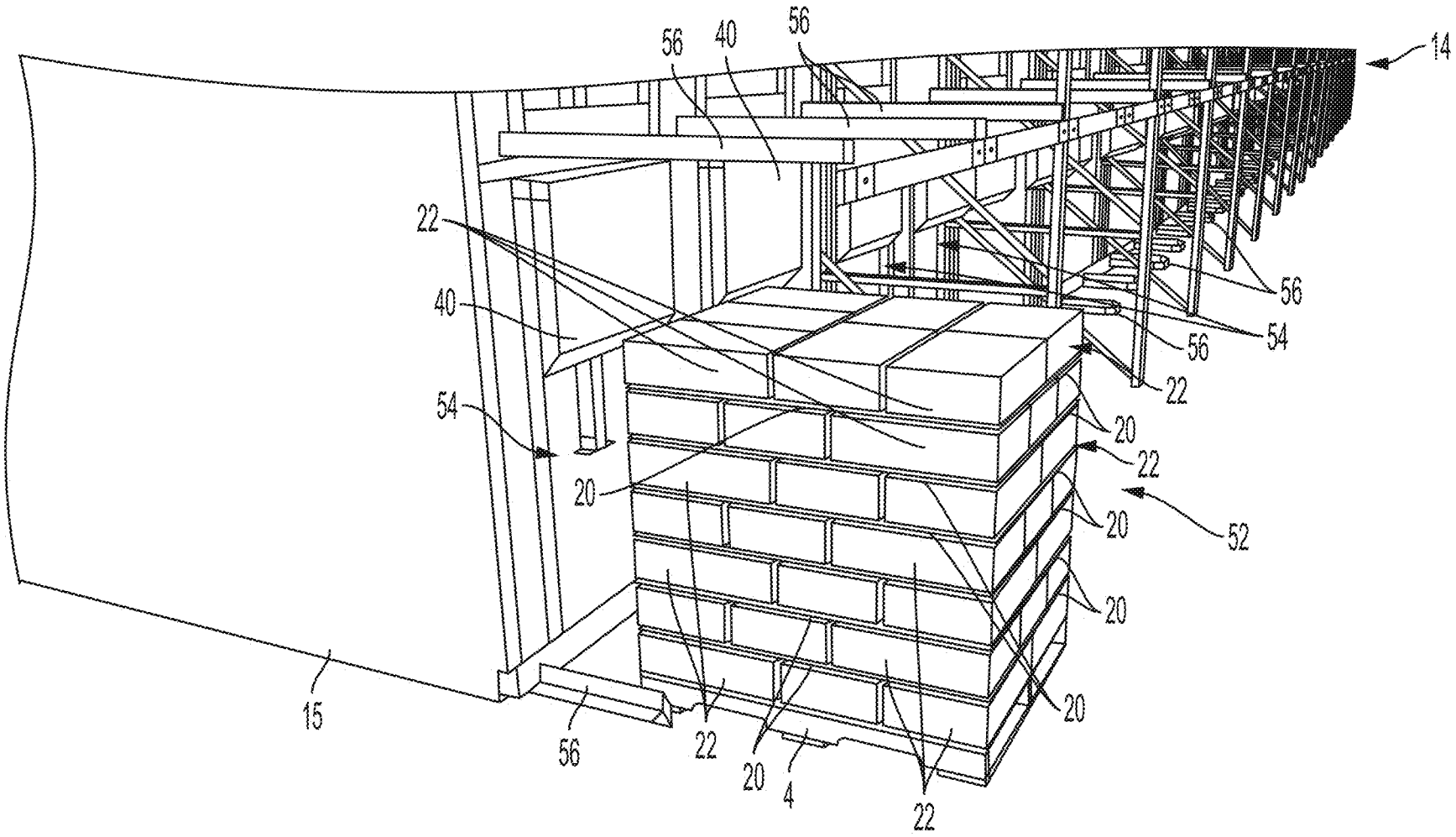
FIG. 6 is a perspective view illustrating loading of pallet assemblies into the racking illustrated, e.g., in FIGS. 3 and 4.
Figure 7:
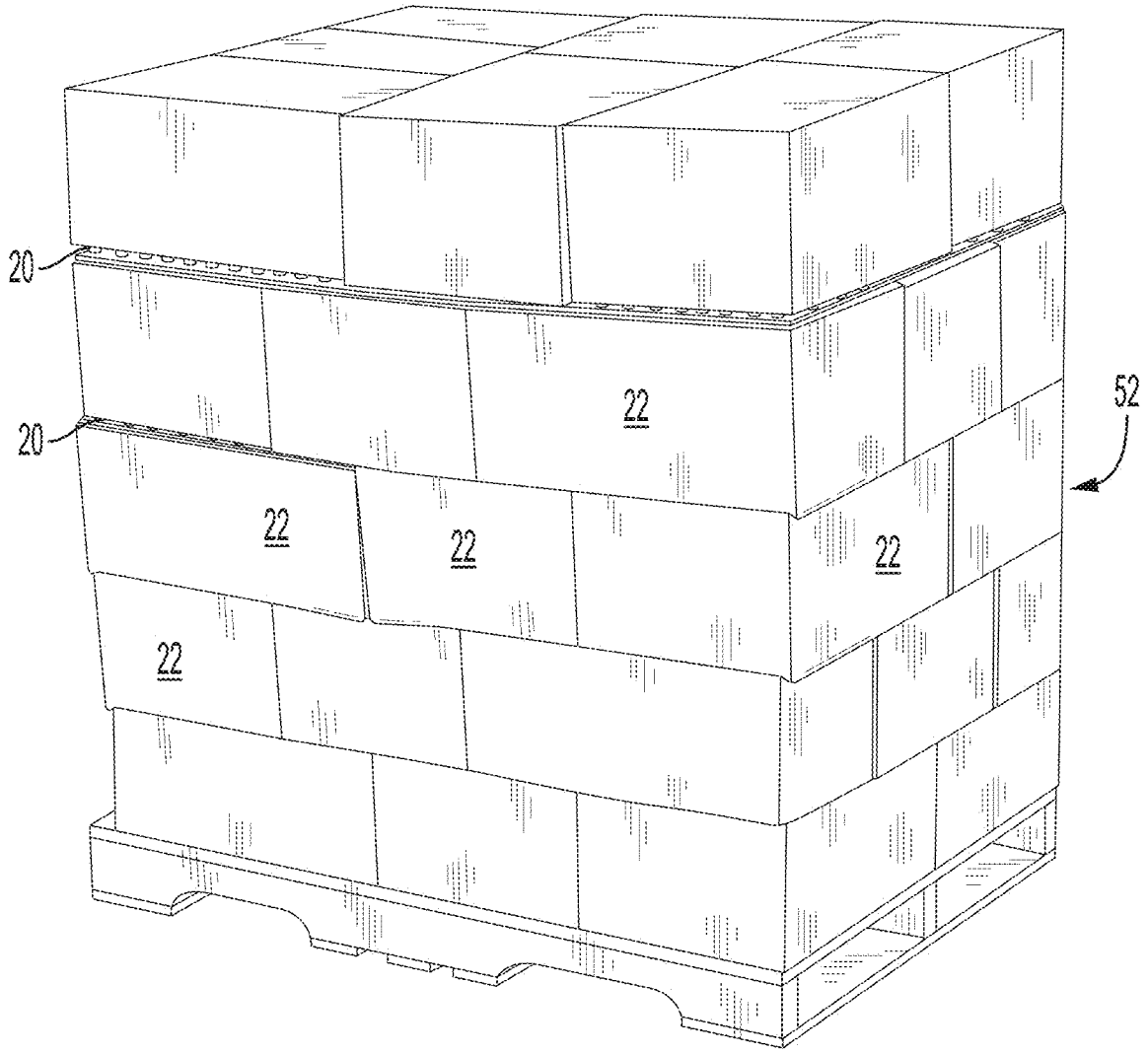
FIG. 7 is a perspective view of a pallet assembly incorporating a predicate spacer.
Figure 8:
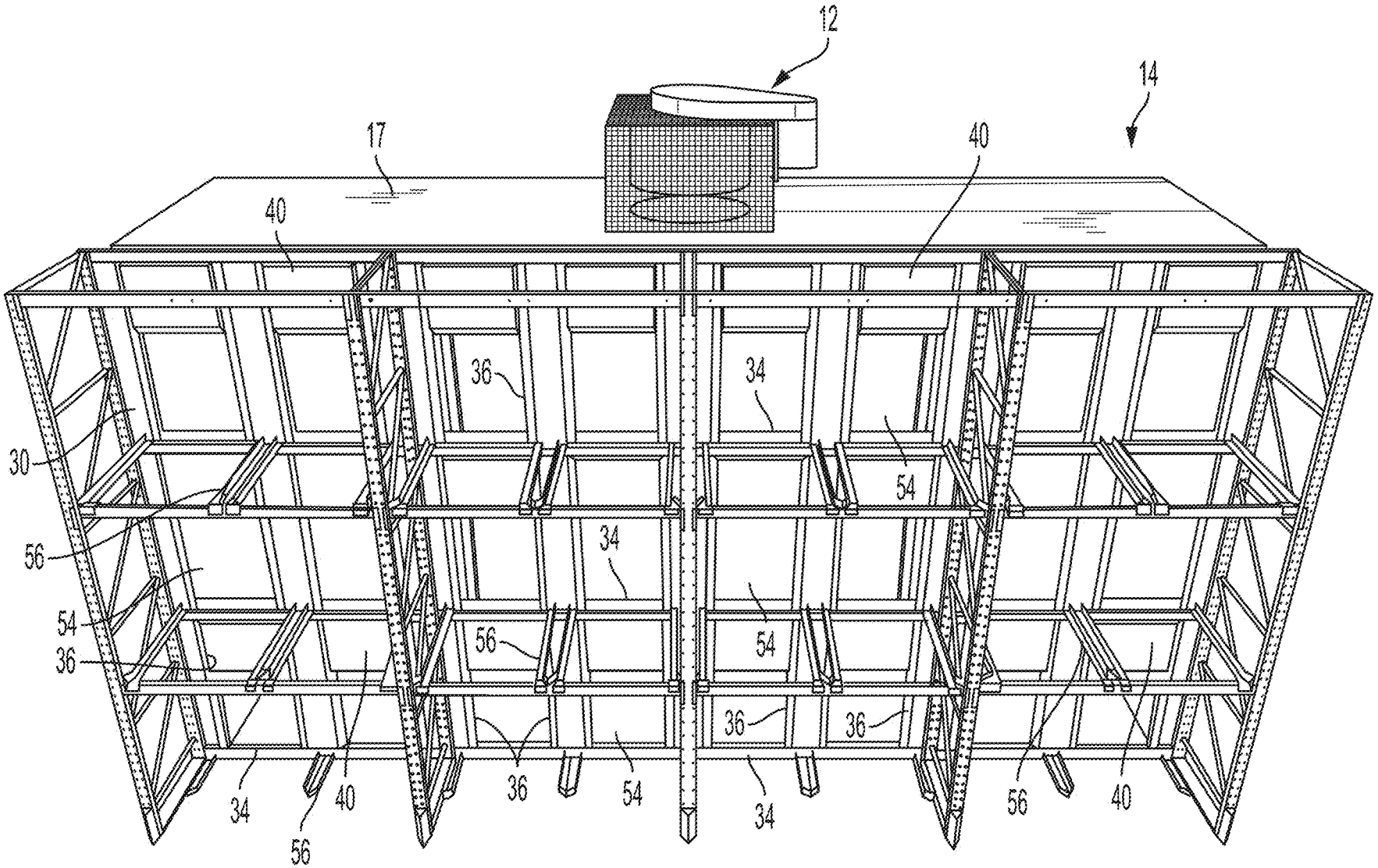
FIG. 8 is a perspective view of a portion of a racking structure accommodating 24 pallet assembly receiving spaces on each side thereof.

As can be seen in FIG. 10, fabric covering 220 may be sized to correspond with an outer profile of a housing or enclosure 202, and in this way, fabric covering 220 can create a volume that is sized to interface with the size of housing 202. Thus, the overall size of the covering 220 is commensurate with the size of the pallet receiving area, and the covering 220 is sized to cover at least a majority (in some instances, all or substantially all) of the pallet assembly 52 when it is received in the pallet receiving area. In the illustrated embodiment, housing or enclosure 202 acts as a support structure for sheet-based sealing system 200. Alternatively, the support structure for sheet-based sealing system 200 may also be positioned within, or be a part of, racking 14 (FIG. 6).

Further, it is contemplated that fabric covering 220 may take a variety of shapes and sizes as required or desired for a particular application, it being understood that fabric covering 220 should be constructed such that the height, width, and length of the fabric covering are sufficient to cover at least a portion of a pallet assembly such as assembly 52 shown in FIG. 10. In another embodiment, fabric covering 220 is constructed to cover at least a majority, and in some embodiments substantially all, of a pallet receiving area configured to receive pallet assembly 52. In the illustrative embodiment of FIG. 10, fabric covering 220 covers substantially all of the pallet receiving area occupied by pallet assembly 52, except of course the front surface through which air flows during use.

Fabric covering 220 is constructed such that a variety of shapes, sizes and/or configurations of pallet assembly 52 may be accepted without adverse effects on the overall system performance (as further described below). As still seen in FIG. 10, pallet assembly 52 comprises a plurality of cases 22 each separated by spacers 30. It may be appreciated that the embodiments of sheet-based seal system 200 disclosed within are constructed to accept a pallet 4 with a single row of cases 22, a pair of rows of cases 22, or a plurality of rows of cases 22, with each row separated by spacers 30 as described above. It may also be appreciated that cases 22 may be a variety of heights, specifically, the top row of cases on pallet assembly 52 may be a variety of heights (e.g., if the top row is incomplete), making the top of pallet assembly 52 uneven.

Sheet-based seal system 200 illustratively includes with a pallet stop 210. Pallet stop 210 is positioned at the rear of the pallet bay and configured to abut the back side of pallet 4 and/or the rear-most cases 22, and in this way pallet stop 210 helps ensure a consistent placement of any pallet 4 that is inserted into sheet-based seal system 200. Pallet stop 210 is placed near the rear portion of fabric covering 220, proximate the interface of fabric covering 220 and housing 202. Pallet stop 210 ensures that pallet assembly 52 is spaced forwardly of screen 214 (described below) to ensure consistent and robust vacuum creation at the back of pallet assembly 52 during operation of system 200.

Referring still to FIG. 10, sheet-based seal system 200 may be used in conjunction with a modular, single-bay vacuum generator as shown. In this embodiment, a fan 212 is coupled to housing 202 to generate the vacuum. In the illustrative embodiment of FIG. 10, fan 212 is angled relative to the ground, such as by being coupled to an angled portion of housing 202. Housing 202 may be constructed of any suitable material, including, but not limited to, aluminum, steel, plastic, polymer, or any other metal or plastic substitute. Housing 202 may also be configured to retain a control box 204, where the control box 204 is configured to couple to and control the fan 212. The control box 204 may control the fan 212 using an on/off control cycle, a duty cycle, or any other type of control cycle. In the present embodiment, fan 212 is coupled to housing 202, but it may be configured to be separate from housing 202. In the present embodiment, fan 212 is configured to pull air out of housing 202 and blow it to the exterior of housing 202. Further, air pulled out of housing 202 by fan 212 is blown back into air chambers 6 and back into the warehouse space 2. It should be appreciated that the upper extent of fan 212 is vertically lower than the upper extent of racking 14. Further details of the modular vacuum generator shown in FIG. 10 may be found in U.S. patent application Ser. No. 16/938,837 entitled MODULAR HEAT TRANSFER SYSTEM and filed Jul. 24, 2021, and in U.S. Pat. No. 10,921,043 entitled MODULAR HEAT TRANSFER SYSTEM and filed Sep. 28, 2019, the entire disclosures of which are hereby expressly incorporated herein by reference.

Figure 11:
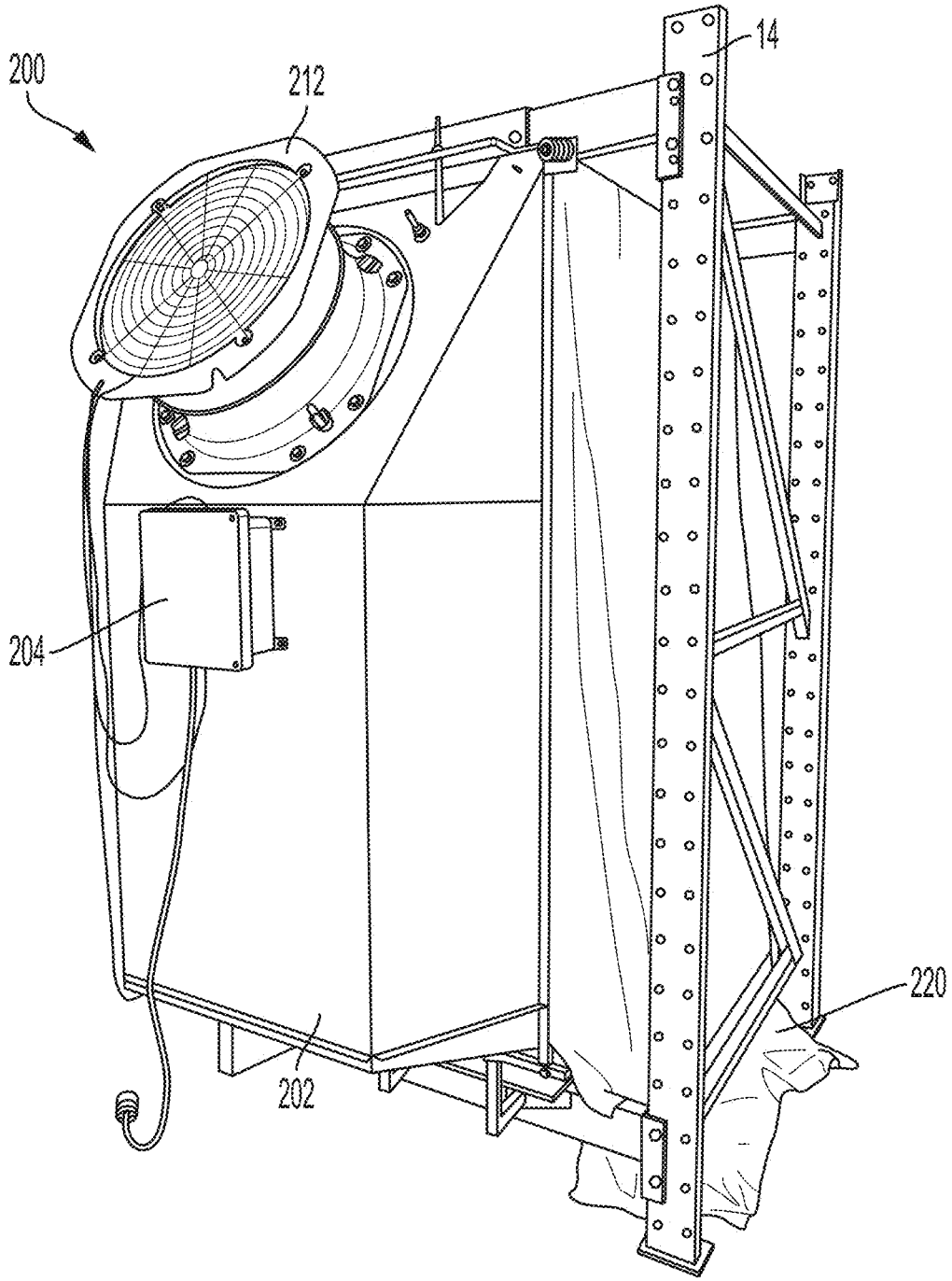
FIG. 11 is a rear left perspective view of the sheet-based seal system of FIG. 10.

Turning to FIG. 11, it can be seen that the housing 202 comprises a volume extending out from rack 14. It may be appreciated that housing 202 may be integrally formed with rack 14, or in other embodiments, housing 202 may be coupled to rack 14 through a series of fasteners, clamps or other coupling mechanisms. In other embodiments, it may be appreciated that housing 202 may be free standing and separate from rack 14 and in this way positioned to abut rack 14 to create a well-functioning seal. Additionally, housing 202 may be configured to be fully contained within racking 14. Fabric covering 220 of sheet-based seal system 200 is further configured to be inside the racking 14 such that fabric covering 220 is located in between racking 14 and pallet assembly 52. It may further be appreciated that racking 14 is constructed so that it is approximately sized to be slightly larger than sheet-based seal system 200. In this way, a sheet-based seal system 200 configured within racking 14 is an efficient packaging size which allows a greater number of sheet-based seal systems 200 and racking 14 to be placed within warehouse 2. In larger racking systems 14 shown in FIGS. 2-4, a sheet-based seal system 200 may be installed in each pallet bay and supported by the structures of racking 14.

The sheet-based sealing system 200 will now be described in greater detail. As first seen in FIG. 12, a mesh screen 214 is positioned between the volume of housing 202 and the volume of the pallet bay, which as shown is substantially or entirely within the spatial extent of fabric covering 220 while at rest. In the present embodiment, mesh screen 214 is coupled to the housing 202 to enclose the forward opening to the interior volume of housing 202. Mesh screen 214 provides a covering from housing 202 such that cases 22 within pallet assemblies 52 are not able to fall into housing 202 while at the same time, air is allowed to freely flow into housing 202 from the pallet bay. In the present embodiment, mesh screen 214 is expanded aluminum, however it may be appreciated that other materials may be used that can provide airflow through mesh screen 214.

Mesh screen 214 is also configured to support vertical members or rear spacers 215. Vertical members 215 are intended to pose a barrier to undesired rearward movement of pallet assembly 52 or cases 22. By preventing such rearward movement of pallet assembly 52 or cases 22, a volume of open space is created between the rear of pallet assembly 52 and the front side of mesh screen 214. In the present embodiment, there are two vertical members 215 which extend the vertical height of housing 202. It may be further appreciated that there may be additional vertical members, or may only extend a portion of the height of housing 202. In the present embodiment, vertical members 215 are configured with a triangular cross-section. In the present embodiment, vertical members 215 act as spacers between the mesh screen 214 and the pallet assembly 52. In this way, vertical members 215 create a separation distance between the mesh screen 214 and the pallet assembly 52.

Figure 12:
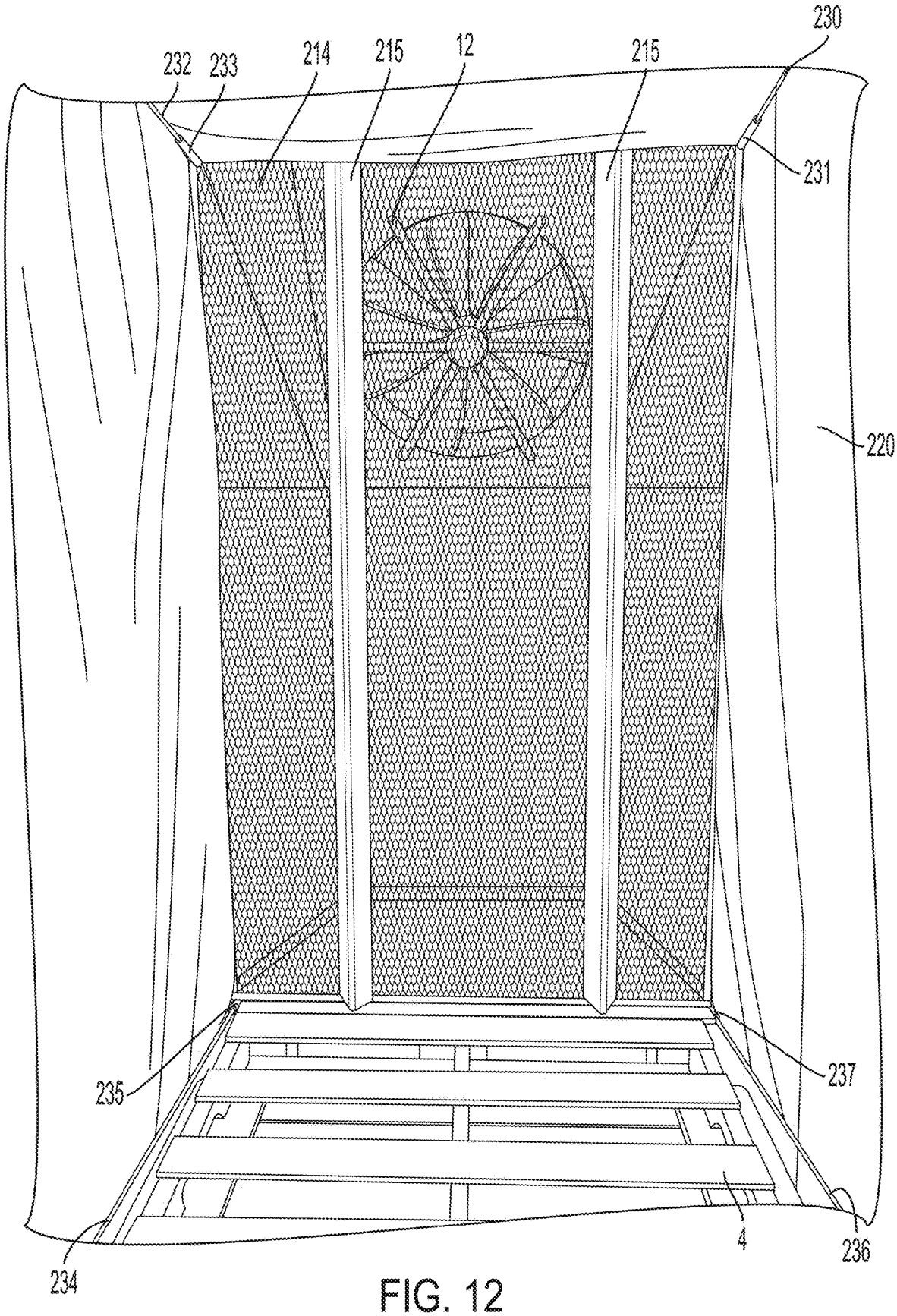
FIG. 12 is a front perspective view of a portion of the sheet-based seal system of FIG. 10.

As can further be seen in FIG. 12, fabric covering 220 is supported by a plurality of flexible rods. Illustratively, when viewing sheet-based seal system 200 from the front, a first flexible rod 230 supports an upper right portion of fabric covering 220, a second flexible rod 232 supports an upper left portion of fabric covering 220, a third flexible rod 234 supports a lower left portion of fabric covering 220, and a fourth flexible rod 236 supports a lower right portion of fabric covering 220. Flexible rods 230, 232, 234, 236 are each cantilevered from their support structure, illustratively housing 202, such that the rods 230, 232, 234, 236 extend horizontally outwardly from the connection end to a free end. In the present embodiment, each of the flexible rods supports a corner of fabric covering 220.

Together, the fabric covering 220 and plurality of flexible rods 230, 232, 234, 236 form a flexible covering assembly. As noted above, for embodiments where housing 202 is not used, e.g., where larger racking assemblies 14 have an array of pallet bays served by a single fan 12 as shown in FIG. 3, flexible rods 230, 232, 234, 236 may be coupled to a front wall portion of racking 14, which will be described further below.

In the embodiment of FIG. 12, flexible rods 230, 232, 234, 236 are mounted to a respective corner of housing 202. It may be understood that a greater number of flexible rods may be used and located intermediate the shown flexible rods, and spaced to further support the fabric covering 220. Further illustrated, flexible rods 230, 232, 234, 236 are mounted to housing 202 using a plurality of bases. As shown, the first flexible rod 230 is placed in a first base 231, the second flexible rod 232 is placed in a second base 233, the third flexible rod 234 is placed in a third base 235, and the fourth flexible rod is placed in a fourth base 235. It may be appreciated that the plurality of flexible rods 230, 232, 234, 236 may be inserted into the plurality of bases 231, 233, 235, 237 through a variety of methods including, but not limited to, a friction fit, adhesive retention, threaded or any other method of retention. Each of the bases 231, 233, 235, 237 may be formed from a rigid material such as steel and fixed, such as by welding or fasteners, to housing 202.

Figure 13:
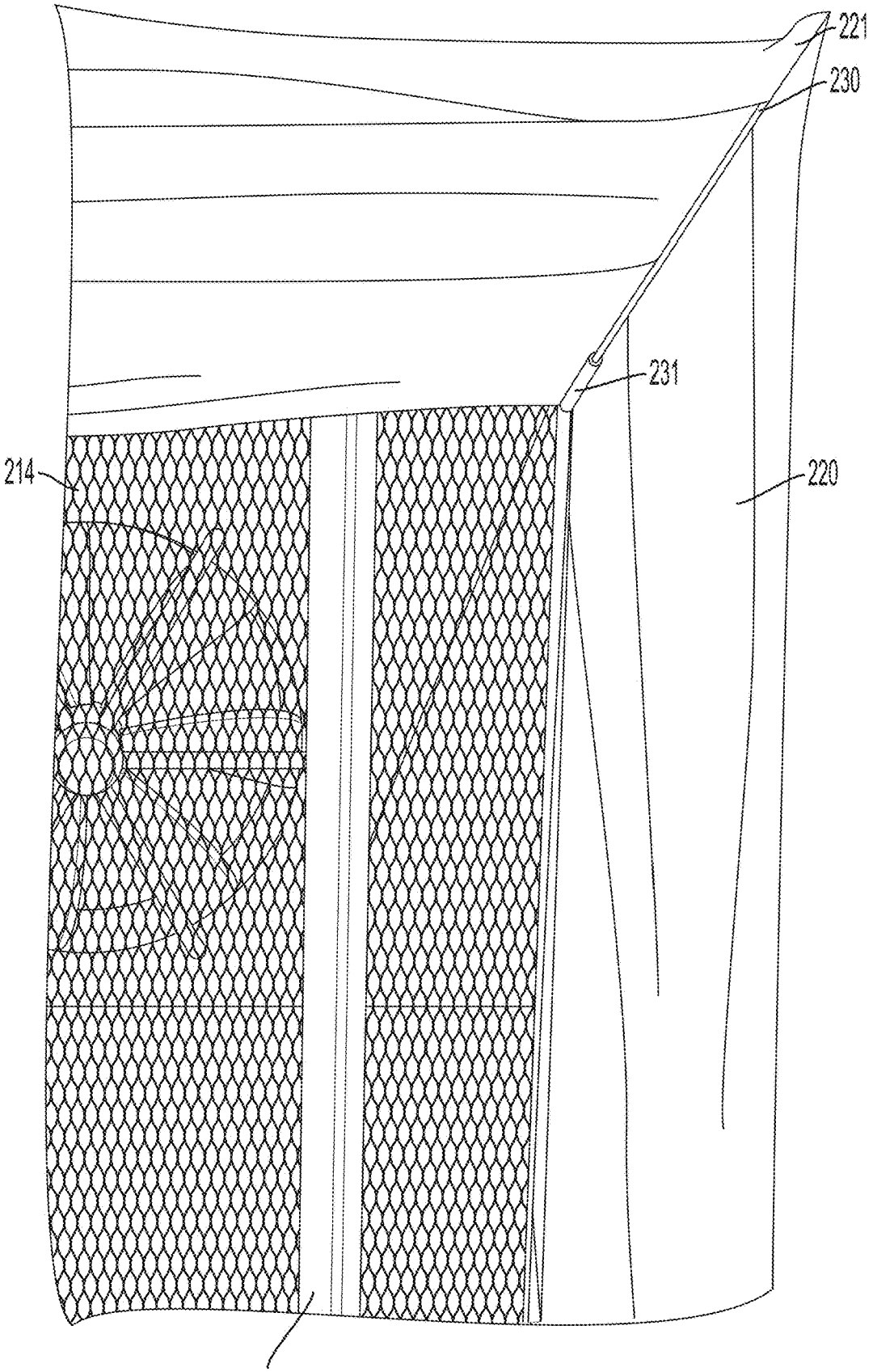
FIG. 13 is an enlarged perspective view of a portion of the sheet-based seal system of FIG. 10.

As best shown in FIG. 13, flexible rod 230 extends along a portion of fabric covering 220 and inserts into a pocket 221. In this way, an outer corner end of fabric covering 220 remains in place and does not move along the length of the flexible rod 230. Pocket 221 may be formed as a hemmed portion at the corner of covering 220, and may be reinforced with additional material as appropriate, such as an insert received in the pocket. While the pocket 221 is shown in FIG. 13 with respect to the bottom left corner of covering 220, it is understood that each corner of fabric covering 220 contains a corresponding pocket 221 corresponding to each flexible rod 230, 232, 234, 236 of sheet-based seal system 200.

In the present embodiment, fabric covering 220 is constructed of a material that is substantially air-impermeable. It is understood that a variety of fabrics may be used, and the effectiveness of sheet-based sealing system 200 will depend upon the air-impermeability of the fabric covering 220. In an exemplary embodiment, covering is durable enough to remain intact through repeated movement and use but also light enough to be supportable by highly flexible (i.e., low modulus) rods 230, 232, 234, 236. It should be understood that fabric covering 220 is configured to be substantially malleable and flexible so that it can conform to a variety of outer shapes, and it may further be affected by the vacuum force created through sheet-based sealing system 200. In one embodiment, covering 220 may be made of a plastic with a thickness between mil and 10 mil.

Flexible rods 230, 232, 234, 236 are constructed of a durable and flexible material such as a polymer, a plastic, a rubber, a combination thereof, or any other suitably flexible material. It is also conceived that flexible rods 230, 232, 234, 236 may be a light-duty steel, aluminum, or other elastically deformable metal that might bend under the force of the vacuum created by fan 212 but "spring back" when the vacuum is removed. It is conceived the flexible rods may additionally be constructed of any other durable and flexible material. In the present embodiment, flexible rods 230, 232, 234, 236 are constructed to be elastically deformable, so that during the course of repeated movement and use, flexible rods 230, 232, 234, 236 will return to their substantially original shape.

Figure 16:
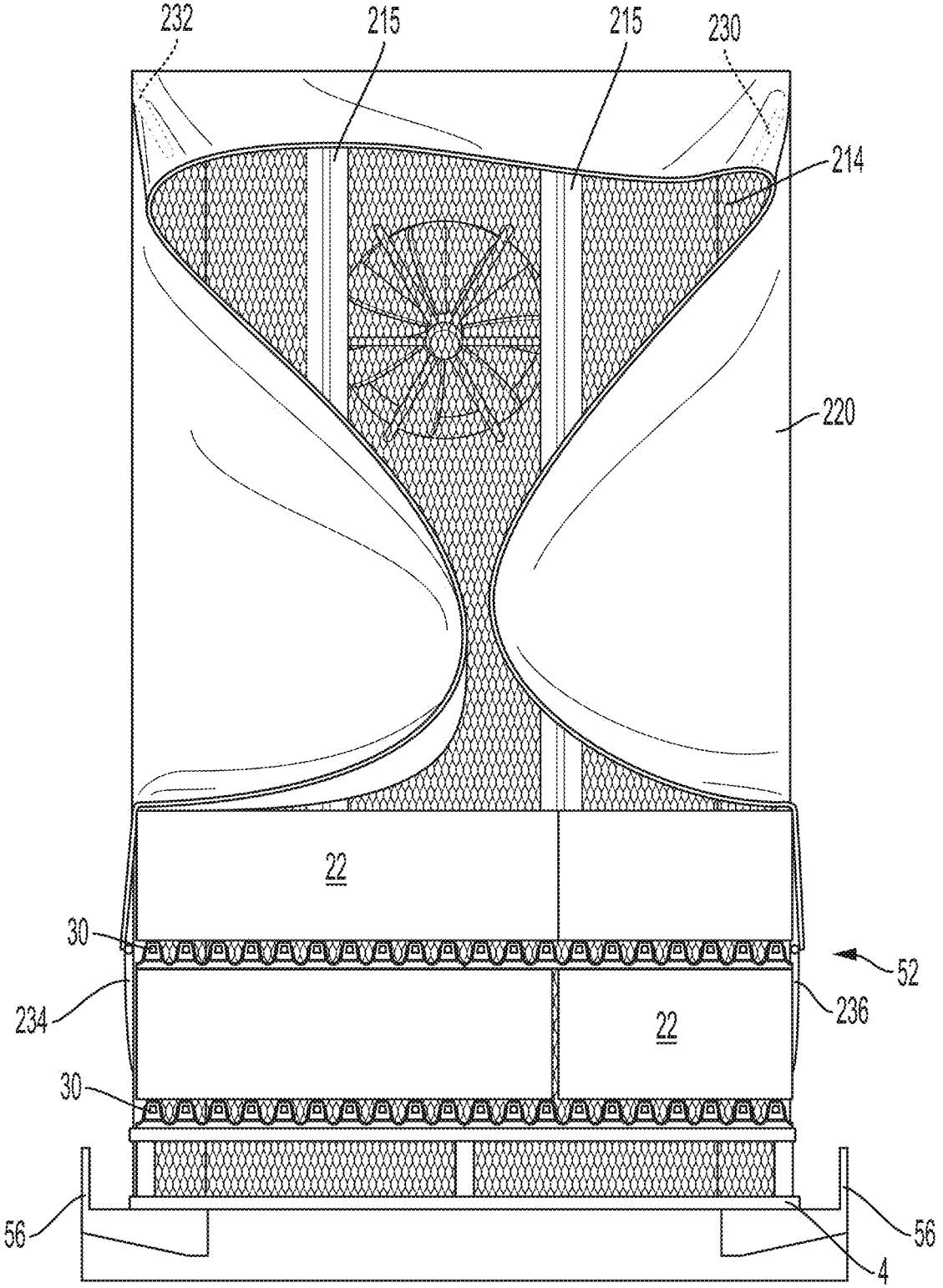
FIG. 16 is a further front view of the sheet-based seal system of FIG. 10, in a nearly fully engaged state.

In the present embodiment, it is appreciated that there is a relationship between the properties of the flexible rods 230, 232, 234, 236 and the fabric covering 220. Specifically, flexible rods 230, 232, 234, 236 are constructed to hold fabric covering 220, and in doing so, in an unengaged or at-rest state or configuration, the flexible rods will deflect less than 10 degrees relative from a plane parallel with a ground floor. In this way, flexible rods 230, 232, 234, 236 are strong enough to hold open the fabric covering 220 for loading and unloading pallets, but flexible enough to allow the fabric covering 220 to collapse under the vacuum created by fan 212, as further described below. Stated another way, the flexible rods 230, 232, 234, 236 have a combination of length, size and modulus of elasticity to provide sufficient rigidity to support fabric covering 220 in an at-rest state (FIG. 14) such that fabric covering 220 defines an opening around the pallet receiving area that is large enough to receive a pallet assembly. At the same time, the flexible rods 230, 232, 234, 236 are specified with sufficient flexibility to deflect into engagement with the pallet assembly upon activation of the fan 212 (FIG. 16).

It is further conceived that flexible rods 230, 232, 234, 236 may be arranged to cooperate with fabric covering 220 in a variety of ways. In an alternative embodiment, fabric covering 220 may drape over at least two of the plurality of flexible rods, in particular, over first flexible rod 230 and second flexible rod 232. In yet anther embodiment, fabric covering may couple with at least a first flexible rod of the plurality of rods and drape over the remaining flexible rods.

Turning now to FIGS. 14-17, the process of use of sheet-based sealing system 200 will be explained in greater detail. As seen in FIG. 14, sheet-based sealing system 200 is shown in a deactivated, at rest, and unengaged state and configuration. In this state, fan 212 is not running, and flexible rods 230, 232, 234, 236 are undeflected except for any at-rest deflection arising from the weigh borne by the rods. This configuration allows pallet assembly 52 to be loaded into the pallet bay at least partially defined by sheet-based sealing system 200. Illustratively, pallet assembly 52 may be inserted between pallet guides 56 to guide pallet into sheet-based sealing system 200. In the present embodiment, pallet guides 56 are coupled with racking 14. It is understood that pallet guides may be integrally formed with racking 14, but may otherwise be coupled through fasteners, clamps, tabs and inserts, or any other form of coupling. In FIG. 14, it should be appreciated that the general profile of fabric covering 220 is generally rectangular, however, it may also be appreciated that a variety of other profiles might be used, including a plurality of curved surfaces.

Figure 15:
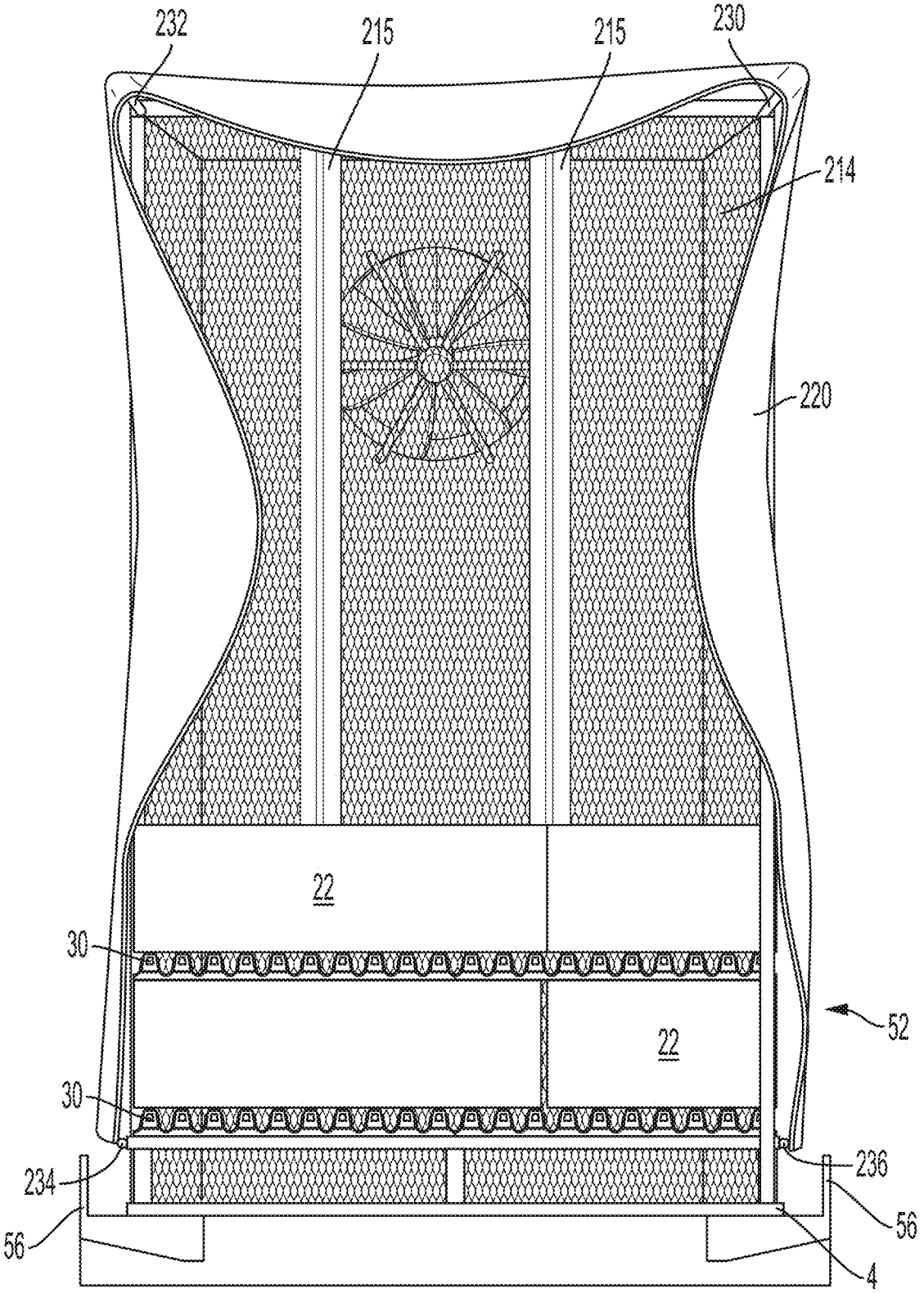
FIG. 15 is another front elevation view of the sheet-based seal system of FIG. 10, in a partially engaged state.

FIG. 15 shows fabric sealing system 200 in a partially engaged state. In this state, fan 212 has been activated and fabric sealing system 200 has begun to enter an engaged state. As fan 212 turns on, a negative pressure is created within housing 202, and this negative pressure passes into the pallet bay defined by cover 220. This causes fabric covering 220 to be biased inwardly towards fan 212, such that cover 220 begins to "wrap" itself around pallet assembly 52. As covering 220 is biased towards pallet assembly 52, the plurality of flexible rods 230, 232, 234, 236 are also biased in towards pallet assembly 52. As the plurality of flexible rods 230, 232, 234, 236 deflect towards pallet assembly 52, cover 220 blocks more airflow through housing 202, and the negative pressure builds within housing 202. As this negative pressure within housing 202 builds, air from within warehouse 2 is pulled through pallet assembly 52 through spacers 30 so that pallet assemblies 52 are cooled or heated.

FIG. 16 shows a progression of sheet-based seal system 200 toward a fully engaged configuration with respect to pallet assembly 52. In this configuration, fan 212 remains activated and continues to create a negative pressure within housing 202. As can be seen, fabric covering 220 is biased towards pallet assembly 52 further than shown in FIG. 15. It is understood that fabric covering 220 is biased in towards pallet assembly 52 in accordance with the negative pressure created by fan 212. Further, the fabric covering 220 is biased inwardly based upon a variety of factors including the power of fan 212, the size of fabric covering 220, the flexibility or elasticity of flexible rods 230, 232, 234, 236, and the size of pallet assembly 52. More specifically, it is understood that the higher the power of the fan 212, the greater the negative pressure created in housing 202 and the more pressure that will be exerted upon flexible rods 230, 232, 234, 236 and fabric covering 220 and the further the system will collapse upon pallet assembly 52. Further, the greater the flexibility of flexible rods 230, 232, 234, 236, the farther that flexible rods 230, 232, 234, 236 will be able to bend in towards pallet assembly 52.

As is illustrated in FIGS. 14-17, pallet assembly 52 only has two layers of cases 22, but it is understood that the fabric sealing system 200 is capable of handling other pallet configurations, including those with a plurality of layers of cases 22. As will be described in greater detail below, this is accomplished through the use of flexible rods 230, 232, 234, 236 as well as fabric covering 220, which generally conform to the shape of pallet assembly 52 regardless of its shape and size.

Figure 17:
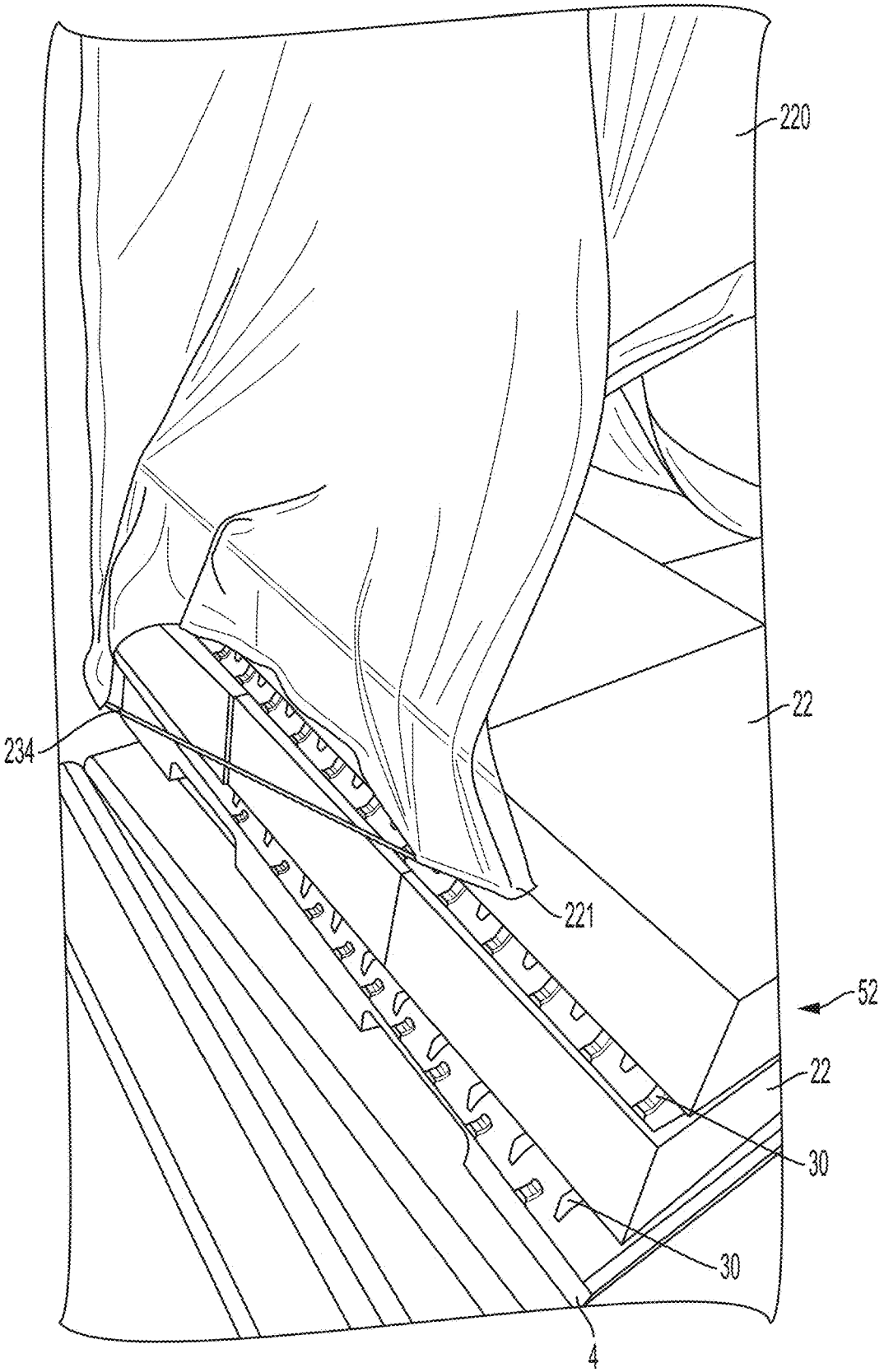
FIG. 17 is a front left perspective view of a portion of the sheet-based seal system of FIG. 16.

FIG. 17 shows a detailed view of a bottom left corner of system 200, in the engaged configuration of FIG. 16. Illustratively, it is shown that when the fabric sealing system 200 is in an engaged configuration and a negative pressure is created within housing 202, third flexible rod 234 is able to be pulled upwardly and inwardly as fabric covering 220 is biased inward toward pallet assembly 52. It is understood that depending upon the size of the pallet assembly, the flexibility of the third flexible rod 234 and the amount of fabric covering 220 that is pulled inwardly toward pallet assembly 52 will affect the movement of third flexible rod 234. Further, while third flexible rod 234 is shown in FIG. 17, it should be appreciated that fourth flexible rod 236 would act in a similar manner on the other side of pallet assembly 52, as a mirror image to the depicted deflection of flexible rod 234. Meanwhile the upper flexible rods 230 and 232 deflect downwardly and inwardly, as shown in FIG. 16, without the constraint of adjacent cases 22.

Figure 18:
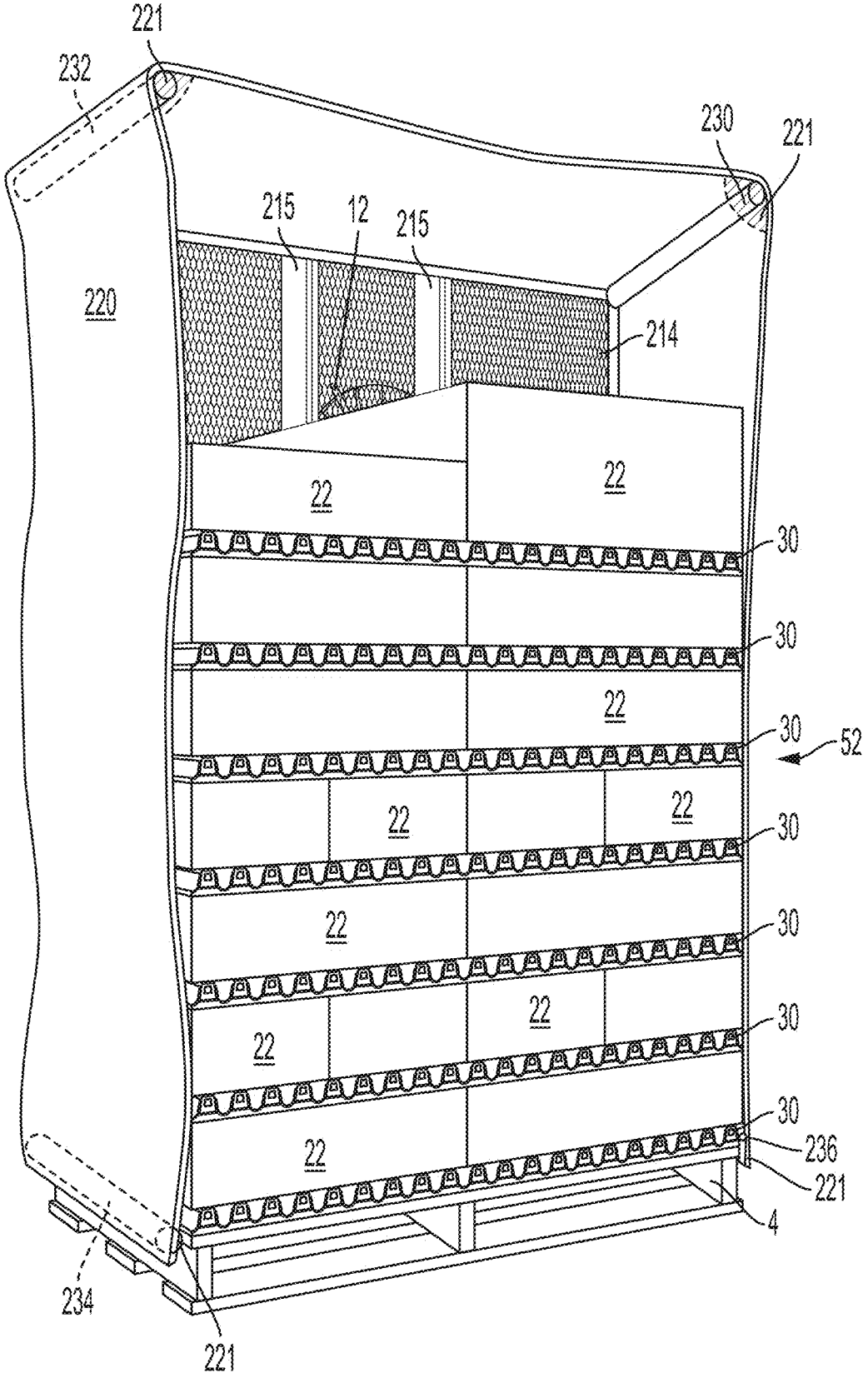
FIG. 18 is a front left perspective view of a sheet-based seal system made in accordance with the present disclosure, shown in an unengaged state.
Figure 19:
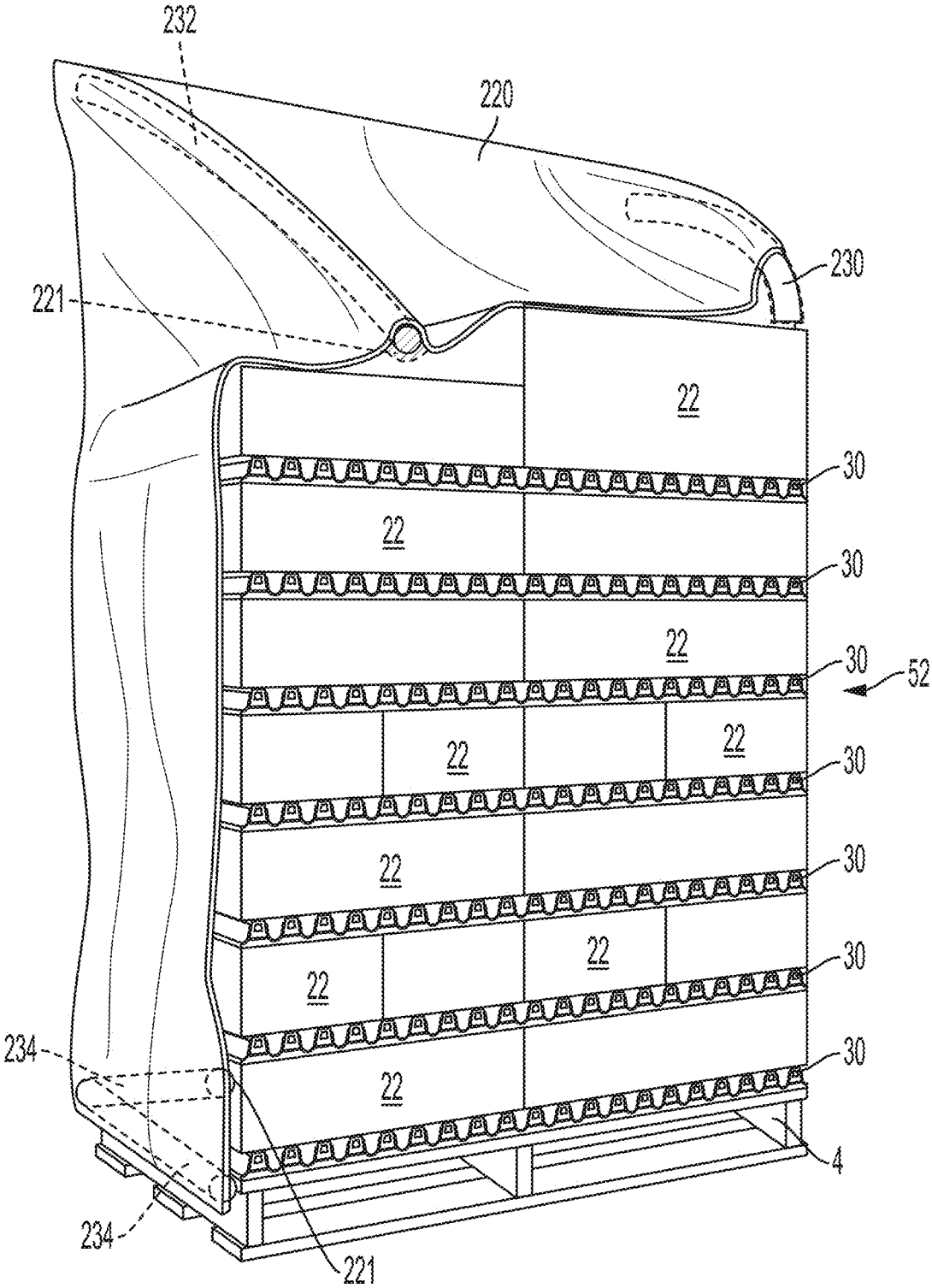
FIG. 19 is a front left view of the sheet-based seal system of FIG. 18, shown in an engaged state.

Turning now to FIGS. 18-19, a configuration of fabric sealing system 200 with a different size and configuration of pallet assembly 52 will be described. Illustratively, the configuration of FIGS. 18-19 includes a greater number of cases 22 filling a greater proportion of the height of fabric sealing system 200, and further, the top level of cases 22 is uneven, such that of the plurality of cases 22 on top level of pallet assembly 52, at least one case 22 is a different height than the other cases 22. An issue associated with a variable height of the top level of cases 22 is a greater degree of difficulty in creating a seal around the tops of cases 22.

As shown best in FIG. 19, fabric sealing system 200 is shown in an engaged position together with a pallet assembly 52 having an uneven top row of cases 22. In the illustrated configuration, fan 212 is in activated and creating a negative pressure in housing 202 behind pallet assembly 52. In the same manner as discussed above with respect to FIGS. 16 and 17, fabric covering 220 is biased inwardly toward pallet assembly 52, and flexible rods 230, 232, 234, 236 also are biased downwardly and inwardly towards pallet assembly 52. Advantageously, each of the flexible rods 230, 232, 234, 236 move independently of one another such that they can each accommodate different sized boxes. As seen in FIG. 19, second flexible rod 232 is biased farther downward than first flexible rod 230 such that both first flexible rod 230 and second flexible rod 232 are able to come in to contact with the top of cases 22, regardless of their height. By allowing flexible rods 230, 232, 234, 236 to move independently of one another, a better seal is able to be created on all sides of pallet assembly 52 by fabric covering 220, regardless of whether the cases 22 are stacked evenly or neatly.

A benefit of fabric sealing system 200 is that a seal is created around pallet assembly 52 allowing a negative pressure to be created behind pallet assembly 52 within housing 202. In this way, air from within warehouse 2 is pulled through pallet assembly 52, into housing 202, and through fan 212. The air may then be transferred directly back into the warehouse 2 or may first go through a separate air chamber 6 before transferring back into the warehouse 2. As previously described, air within warehouse 2 is preconditioned to an appropriate temperature so that when air is pulled through pallet assemblies 52, contents of pallet assembly 52 are cooled or heated.

As noted above, sheet-based sealing system 200 has been disclosed herein in connection with housing 202 of an air management system serving a single pallet position. Sheet-based sealing system 200 and its fabric covering 220 may be positioned within individual pallet bays of racking 14 without a housing 202. For example, racking 14 may have a front wall (FIG. 8) configured to receive flexible rods 230, 232, 234, 236. In an embodiment, the front wall would include mesh screen 214 positioned, e.g., in airflow openings 54 (FIG. 8) to allow airflow through the front wall while also supporting cases 22 and pallet 4, as described above. In this way, as is best shown in FIGS. 2-4, air is allowed to be pulled through pallet assembly 52, through the front wall, and into air chamber 6. Thus, fans 12 pull air from air chamber 6 creating a negative pressure in air chamber 6 to serve multiple pallet positions, rather than a single fan 212 serving a single position as described above. As a negative pressure is built within air chamber 6, flexible rods 230, 232, 234, 236 and fabric covering 220 are biased inward to contact the pallet assembly 52 in the same manner as described above with respect to housing 202. In this way, fabric covering 220 creates an exemplary seal around each pallet assembly 52 in an array of pallet assemblies, without the use of housing 202. This may allow for economies of scale. In addition, sheet-based sealing system 200 may include a fabric covering 220 which is capable of substantially blocking airflow through opening 54 even in the total absence of pallet assembly 52. Thus, sheet-based sealing system 200 may perform "vacant bay compensation" for pallet assembly 52, preventing or substantially reducing airflow through openings 54 at vacant pallet positions. In this way, sheet-based sealing system 200 may allow for energy-efficient maintenance of a desired negative pressure in chamber 6 even as pallet assemblies are removed or repositioned from an array of positions in racking 14.

In one embodiment, flexible rods 230, 232, 234, 236 may be mounted to front wall (not shown) of racking 14 through first base 231, second base 233, third base 235, and fourth base 237. Bases 231, 233, 235, 237 may be coupled to the front wall or racking 14, or may be formed as an integral part of the front wall. It is also conceived that no bases may be used, and flexible rods 230, 232, 234, 236 may be integral to the front wall, or operably coupled to front wall without an intervening base.

While this disclosure has been described as having exemplary designs, the present invention can be further modified within the spirit and scope of this disclosure. This application is therefore intended to cover any variations, uses, or adaptations of the disclosure using its general principles. Further, this application is intended to cover such departures from the present disclosure as come within known or customary practice in the art to which this disclosure pertains and which fall within the limits of the appended claims.

What is claimed is:

1. A pallet sealing assembly configured for use adjacent a pallet receiving area sized to receive a pallet assembly, the pallet receiving area served by a fan that is positioned to move air from inside the pallet receiving area to outside the pallet receiving area, the assembly comprising:

a cover made of a flexible sheet of material having an upper portion, a left portion extending from a lower left free end to an upper left juncture with the upper portion, and a right portion opposite the left portion and extending from a lower right free end to an upper right juncture with the upper portion, the material supported in an open configuration in which the cover defines an opening having an upstream end and an opposing downstream end disposed at upstream and downstream ends of the pallet receiving area respectively, the upstream end of the opening sized to receive the pallet assembly, the cover being deflectable from the open configuration into a collapsed configuration in which the cover is drawn downwardly upon activation of the fan downstream of the downstream end to create a negative pressure within the pallet receiving area, such that the cover can substantially sealingly engage a pallet received within the opening.

2. The pallet sealing assembly of claim 1, further comprising a flexible cover support engaged with and supporting at least a portion of the cover.

3. The pallet sealing assembly of claim 2, wherein the cover is resiliently biased into the open configuration by the flexible cover support.

4. The pallet sealing assembly of claim 3, wherein the flexible cover support comprises at least one flexible rod.

5. The pallet sealing assembly of claim 4, wherein the at least one flexible rod is coupled to a support structure adjacent the pallet receiving area.

6. The pallet sealing assembly of claim 1, wherein the cover is drawn downwardly by operation of the fan.

7. The pallet sealing assembly of claim 1, further comprising a controller programmed to:

receive an electronic activation signal; and upon receiving the electronic activation signal, activating a sealing configuration of the pallet sealing assembly by automatically deflecting the cover from the open configuration to the collapsed configuration.

8. The pallet sealing assembly of claim 7, wherein the controller is further programmed to:

receive an electronic de-activation signal; and upon receiving the electronic de-activation signal, de-activating the sealing configuration of the pallet sealing assembly by automatically repositioning the cover from the collapsed configuration to the open configuration.

9. The pallet sealing assembly of any of claim 8, wherein:

the controller is programed to provide electrical power to the fan when activating the sealing configuration; and the controller is programed to prohibit electrical power to the fan when de-activating the sealing configuration.

10. The pallet sealing assembly of claim 1, wherein the pallet receiving area is formed as a part of a racking assembly defining an array of the pallet receiving areas.

11. A pallet sealing assembly comprising:

a support structure adjacent a pallet receiving area sized to receive a pallet assembly, the pallet receiving area served by a fan that is positioned and configured to move air from inside the pallet receiving area to outside the pallet receiving area;

a plurality of flexible rods coupled to the support structure and extending away from the support structure; and a cover supported by the plurality of flexible rods, the plurality of flexible rods having sufficient rigidity to support the cover in an at-rest state such that the cover defines an opening around the pallet receiving area, the opening sized to receive the pallet assembly, the plurality of flexible rods having sufficient flexibility to deflect into engagement with the pallet assembly upon activation of the fan.

12. The pallet sealing assembly of claim 11, wherein the cover is disposed around a periphery of the pallet receiving area.

13. The pallet sealing assembly of claim 11, further comprising:

a front wall coupled with the support structure, the front wall having at least one airflow aperture therethrough, the cover disposed around a periphery of the at least one airflow aperture.

14. The pallet sealing assembly of claim 13 further comprising:

at least one spacer coupled to the front wall and configured to maintain a separation distance between the front wall and the pallet assembly.

15. The pallet sealing assembly of claim 11 wherein the pallet receiving area further comprises at least one pallet guide at a periphery of the pallet receiving area, such that the at least one pallet guide is positioned to constrain a lateral movement of the pallet assembly.

16. The pallet sealing assembly of claim 11, wherein the plurality of flexible rods are independently moveable relative to one another.

17. The pallet sealing assembly of claim 11, wherein the plurality of flexible rods are cantilevered from the support structure.

18. The pallet sealing assembly of claim 11, wherein the cover is sized commensurate with the pallet receiving area.

19. The pallet sealing assembly of claim 18, wherein the cover is sized to cover at least a majority of a standard-sized pallet assembly when the pallet assembly is received in the pallet receiving area.

20. A palletized product heat transfer system comprising:

an enclosure comprising a plurality of panels, the enclosure configured with an intake opening and an exhaust opening, and the enclosure coupled to a rack assembly, the intake opening positioned adjacent a pallet receiving area, the pallet receiving area sized to receive a pallet assembly;

a plurality of flexible rods coupled to the enclosure and extending away from the enclosure; and a flexible covering supported by the plurality of flexible rods, the plurality of flexible rods having sufficient rigidity to support the covering in a first state in which the covering defines an opening around the pallet receiving area, the opening sized to receive the pallet assembly, the plurality of flexible rods having sufficient flexibility to deflect into a second state engaged with the pallet assembly in the presence of an airflow driven from the intake opening to the exhaust opening.

21. The palletized product heat transfer system of claim 20, further comprising:

a fan disposed between the intake opening and the exhaust opening, the fan configured to create the airflow from inside the enclosure to outside the enclosure, such that a negative pressure is formed within the enclosure.

22. The palletized product heat transfer system of claim 21, wherein the pallet assembly comprises a plurality of air channels configured to allow air to pass through the pallet assembly in response to the negative pressure.

23. The palletized product heat transfer system of claim 22, wherein the flexible covering moves from the first state to the second state in response to the negative pressure within the enclosure.

24. The pallet sealing assembly of claim 1, wherein the opening defined by the cover is a three-sided opening configured to create an airtight seal on three sides of the pallet assembly when the cover is deflected into the collapsed configuration.

25. The palletized sealing assembly of claim 11, wherein the opening defined by the cover is a three-sided opening configured to create an airtight seal on three sides of the pallet assembly when the cover is deflected into the collapsed configuration.

* * * * *